US006162046A

United States Patent [19]

Young et al.

[11] Patent Number: 6,162,046

[45] **Date of Patent: *Dec. 19, 2000**

[54] LIQUID VAPORIZATION AND PRESSURIZATION APPARATUS AND METHODS

[75] Inventors: Thomas M. Young, Orinda; Niels O. Young, deceased, late of San Rafael, both of Calif.; by Lucy J. Young, legal representative, Thetford Hill, Vt.

[73] Assignee: Allports LLC International, Boise, Id.

[ * ] Notice: This patent is subject to a terminal disclaimer.

[21] Appl. No.: 08/899,181

[22] Filed: Jul. 23, 1997

Related U.S. Application Data

[63] Continuation-in-part of application No. 08/439,093, May 10, 1995, Pat. No. 5,692,095.

[51] Int. Cl.[7] ..... F23D 11/44; F23L 15/00

[52] U.S. Cl. ..... 431/11; 431/208; 431/241; 126/45; 126/96

[58] Field of Search ..... 431/208, 32, 206, 431/11, 243, 102, 344, 241, 259; 123/549; 126/40, 45–47, 96

[56] References Cited

U.S. PATENT DOCUMENTS

| | | | |
|---|---|---|---|
| 799,581 | 9/1905 | Trewhella et al. | 431/241 |
| 1,225,381 | 5/1917 | Wedge et al. | 431/328 |
| 1,905,610 | 4/1933 | Stoll | 431/208 |
| 1,944,821 | 1/1934 | Blaise et al. | 167/3 |
| 3,234,928 | 2/1966 | Smith | 123/142.5 |
| 3,262,290 | 7/1966 | Huber | 67/55 |
| 3,663,152 | 5/1972 | Yoshida | 431/344 |
| 3,869,242 | 3/1975 | Schladitz | 431/208 |
| 4,134,718 | 1/1979 | Kayfetz et al. | 431/125 |
| 4,193,755 | 3/1980 | Guarnaschelli et al. | 431/207 |
| 4,318,689 | 3/1982 | Förster et al. | 431/208 |
| 4,365,952 | 12/1982 | Ohmukai et al. | 431/208 |
| 4,552,124 | 11/1985 | Nakajima | 126/413 |
| 4,571,481 | 2/1986 | Leary | 431/208 X |
| 4,684,341 | 8/1987 | Kawamura et al. | 431/208 |
| 4,703,888 | 11/1987 | Kawamura et al. | 273/12.3 C |
| 5,113,478 | 5/1992 | Nakashima et al. | 431/208 |
| 5,484,086 | 1/1996 | Pu | 222/187 |
| 5,692,095 | 11/1997 | Young | 392/395 |

*Primary Examiner*—James C. Yeung
*Attorney, Agent, or Firm*—Ann W. Speckman

[57] ABSTRACT

A vaporization/pressurization module employs a porous member having a low thermal conductivity and a substantially uniform, small pore size. Liquid feed is introduced to the porous member and is heated, vaporized, and pressurized within and/or on a surface of the porous member to produce a vapor jet having a pressure higher than that of the liquid feed. A substantially vapor impermeable barrier facilitates accumulation and pressurization of the vapor, which is released from the module as a pressurized vapor jet from one or more restricted passages. The vaporization/pressurization module is especially useful for liquid fuel combustion applications.

23 Claims, 18 Drawing Sheets

LIQUID VAPORIZATION AND PRESSURIZATION APPARATUS AND METHODS

CROSS REFERENCE TO RELATED APPLICATION

This application is a continuation-in-part of U.S. patent application Ser. No. 08/439,093, filed May 10, 1995, now issued as U.S. Pat. No. 5,692,095.

TECHNICAL FIELD

The present invention relates to methods and apparatus in which liquid is vaporized and pressurized in an enclosed porous member, and relates particularly to methods and apparatus for vaporizing liquid fuels to produce a combustible mixture under pressure. Combustion apparatus employing a vaporization/pressurization module and combustion methods of the present invention are especially suitable for use as light and heat sources for stoves, burners, lamps, appliances, thermal to electric conversion systems and the like.

BACKGROUND OF THE INVENTION

Conventional boilers add heat to a reservoir or inflow of liquid to convert the liquid to vapor. To sustain the inflow of liquid in a pressurized boiler system, the liquid must be supplied under at least as much pressure as that of the outgoing vapor. In a typical industrial boiler, the liquid is pumped into the boiler according to the desired vapor pressure. A throttle controls the flow of vapor from the boiler and, correspondingly, the vapor pressure within the boiler. Feed pumps supply water to the boiler according to the vapor pressure to maintain a constant liquid level in the boiler. If the vapor pressure is increased by reducing flow through the throttle, then the pumping pressure is decreased to maintain the level of liquid in the boiler. Usually, the throttle is operatively coupled to the feed pump(s) so that the pumping pressure is automatically adjusted according to the flow through the throttle and, correspondingly, the vapor pressure in the boiler. This mechanism of automatically controlling the performance of the feed pumps is commonly referred to as a servomechanism.

In most liquid fuel vaporization applications, liquid fuel is vaporized, then mixed with air or an oxygen-containing gas, and the vaporized fuel/gas mixture is ignited and burned. The liquid fuel is generally supplied under pressure, and vaporized by mechanical means or heated to vaporization temperatures using an external energy source.

Portable burners and light sources that utilize liquid fuels generate liquid fuel vapor, which is then mixed with air and combusted. Combustion devices that burn fuels that are liquids at atmospheric temperatures and pressures, such as gasoline, diesel fuel and kerosene, generally require the liquid fuel to be pressurized by a pump or other device to provide vaporized fuel under pressure. Fuels such as propane and butane, which are gases at atmospheric pressures but liquids at elevated pressures, can also be used in portable burners and light sources. Storage of these fuels in a liquid form necessitates the use of pressurized fuel canisters that are inconvenient to use and transport, are frequently heavy, may be explosion hazards, and require valves which are prone to leaking.

The fuel boiler of propane and butane burners is the reservoir or storage tank itself, from which the gases are released under pressure as vapor. When vapor is withdrawn from the fuel reservoir, the pressurized reservoir acts as a boiler, and draws the required heat of vaporization from ambient air outside the tank. These systems have many disadvantages. The vapor pressure of propane inconveniently depends upon ambient temperature, and the vapor pressure is generally higher than that needed for satisfactory combustion in a burner. While butane fuel has an advantageous lower vapor pressure than propane, burners using butane have difficulty producing sufficient vapor pressure at low ambient temperatures. Burners using a mixture of propane and butane fuel provided under pressure in disposable canisters have also been developed. This fuel mixture performs well at high altitudes, but still does not perform well at low ambient temperatures.

A needle valve can be used to control propane vapor at tank pressure to regulate the fuel flow, and thus the heat output, of a burner. Burner control using a needle valve tends to be delicate and sensitive to ambient temperatures. Alternatively, a pressure regulator can be used to generate a constant and less hazardous pressure of propane that is independent of tank temperature. Propane pressure regulators are commonly used in outdoor grills, appliances for recreational vehicles and boats, and domestic propane installations. Unfortunately, regulators are bulky and are seldom practical for application to small scale portable burner devices.

Despite considerable development efforts and the high market demand for burners for use in stoves, lamps and the like, that operate safely and reliably under a wide variety of ambient temperature, pressure and weather conditions, commercially available combustion devices are generally unsatisfactory.

Wicking systems that use capillary action to convey and vaporize liquid fuels at atmospheric pressure are known for use in liquid fuel burners. U.S. Pat. No. 3,262,290, for example, discloses a liquid fuel burner in which a wick stone is fastened in a fuel storage container and feeds liquid fuel from the fuel reservoir to the burner. In this system, liquid fuel is provided to the wick stone by an absorbent textile wick, and the wick stone is biased against a burner wick.

U.S. Pat. No. 4,365,952 discloses a liquid fuel burner in which liquid fuel is drawn up from a reservoir by a porous member having a fuel receiving section and a fuel evaporation section. Liquid fuel is supplied by capillary action at a rate matching the rate of evaporation of the fuel. Air is supplied to the fuel evaporation section, and liquid fuel is evaporated from the surface at a rate corresponding to the rate of air supply. The gaseous fuel and air is mixed and jetted from a flame section to a burning section. An externally powered heater maintains the porous member of the fuel evaporation section substantially at a constant temperature irrespective of the rate of evaporation of the liquid fuel.

U.S. Pat. No. 4,421,477 discloses a combustion wick comprising a fuel absorption and a fuel gasifying portion designed to reduce the formation and deposition of tar-like substances in the wick. The wick comprises silica-alumina ceramic fibers molded with an organic binder, with part of the wick provided with a coating of an inorganic pigment, silicic anhydride and a surface active agent. The wick preferably has a capillary bore size of about 1 to 50 microns, with smaller pore size wicks being less prone to accumulation of tar-like substances on the inside.

U.S. Pat. No. 4,465,458 discloses a liquid fuel combustion system in which the liquid fuel is drawn into a porous fiber material or fabric, which is intimately contacted by an externally powered heat generating member to evaporate and vaporize the liquid fuel. Air is introduced to promote vaporization of the liquid fuel and provide an admixed liquid/fuel mixture for burning. Combustion is variable by adjusting the heat input and the air supply.

U.S. Pat. No. 4,318,689 discloses a burner system in which liquid fuel is pumped into a cylindrical chamber having a porous side wall. As a result of the pressure differential, the liquid fuel penetrates the porous wall to form a film on the external surface of the porous chamber wall. Preheated combustion air entrains and vaporizes the liquid fuel film formed on the external wall of the chamber, and circulates the fuel/air mixture to a combustion chamber. A portion of the hot exhaust or combustion gases may be returned for countercurrent heat exchange to preheat the combustion air.

Although the prior art discloses numerous types of liquid fuel combustion systems, most liquid fuel vaporizers require the application of energy from an external source, such as heat energy, pressure for pressurizing the liquid fuel and/or vapor, or a blower for jetting an air stream to entrain the vaporized fuel for burning. Prior art liquid fuel combustion systems generally provide vaporization of liquid fuels at atmospheric pressures or, if a pressurized vapor stream is desired, either require the fuel supply to be pressurized or pressurize the vapor by external means. Many of the systems are complex and are not suitable for liquid fuel combustion apparatus that are robust, portable or that are suitable for small scale heating or lighting applications.

It is, therefore, an object of the present invention to provide an apparatus for vaporization and pressurization of liquids, including liquid fuels, within a vaporization/pressurization module having a porous member.

It is another object of the present invention to provide a vaporization/pressurization module that produces a pressurized vapor jet from liquid such as liquid fuel supplied at ambient pressures without requiring the use of pumps or other mechanical means.

It is yet another object of the present invention to provide a vaporization/pressurization module that produces a vapor jet at substantially constant pressures and at a substantially steady flow rate.

It is still another object of the present invention to provide a combustion apparatus employing a vaporization/pressurization module to vaporize liquid fuels, and to produce a pressurized fuel vapor jet.

It is yet another object of the present invention to provide a liquid fuel combustion apparatus that, following ignition, operates in a closed-loop feedback, steady state system that does not require energy input from an external source.

It is still another object of the present invention to provide a liquid fuel combustion apparatus which does not require priming and in which combustion and steady state operation can be conveniently initiated by application of heat from a match or lighter.

It is yet another object of the present invention to provide a liquid fuel combustion apparatus that can operate using any one of two or more different types of liquid fuel.

It is still another object of the present invention to provide a simplified combustion apparatus that generates heat and light by combustion of vaporized, pressurized liquid fuel that can be conveniently provided in a lightweight, portable and/or miniaturized form.

SUMMARY OF THE INVENTION

The liquid vaporization and pressurization apparatus of the present invention utilizes a vaporization/pressurization module employing a porous member having a low thermal conductivity and a substantially uniform, small pore size. The porous member has a liquid feed surface in proximity to a liquid feed system and a vaporization zone in proximity to a heat source. Liquid feed is introduced to the porous member at the liquid feed surface and is heated, vaporized and pressurized within and/or on a surface of the porous member. Egress of vapor to a location remote from the porous member is substantially constrained or is substantially constrainable by means of a substantially vapor impermeable barrier provided in proximity to surfaces of the porous member other than the liquid feed surface. The substantially vapor impermeable barrier facilitates accumulation and pressurization of the vapor, which is released from the vaporization/pressurization module as a pressurized vapor jet from one or more restricted passage(s) formed in the substantially vapor impermeable barrier.

The barrier is referred to herein as "substantially" vapor impermeable because it is vapor impermeable except in predetermined locations where egress of one or more pressurized vapor jet(s) is permitted. The substantially vapor impermeable barrier facilitates pressurization of vapor within the porous member and the enclosed space formed by the barrier, and promotes generation of one or more vapor jet(s) at a pressure greater than that of the liquid feed which is generally provided at atmospheric pressure. According to preferred embodiments, egress of vapor is limited by a substantially vapor impermeable barrier having one or more restricted passage(s) permitting egress of pressurized vapor, the passage(s) constituting less than about 5%, more preferably less than 2%, and most preferably less than about 0.5%, of the surface area of the substantially impermeable barrier.

The vaporization/pressurization module of the present invention may be provided as an independent unit for a variety of applications. The vaporization/pressurization module comprises a porous member, a heat source and a substantially vapor impermeable barrier. A liquid feed system provides liquid to the vaporization/pressurization module. Liquid is generally provided at ambient temperatures and pressures to the liquid feed surface of the porous member and is drawn into the porous member and conveyed to a vaporization zone within and/or on a surface of the porous member by capillary forces. During operation, the heat source is used to establish and maintain a thermal gradient within the porous member between the liquid feed surface and the vaporization zone. Liquid drawn into the porous member is heated as it traverses the porous member until it reaches its vaporization temperature in the vaporization zone. Vapor pressure within the vaporization/pressurization module accumulates as liquid is vaporized, and is maintained as a consequence of the substantially vapor impermeable barrier. One or more pressurized vapor jet(s) exit the substantially vapor impermeable barrier only at one or more restricted passage(s).

For liquid fuel combustion applications, a burner assembly is provided in combination with the vaporization/pressurization module and liquid feed system to facilitate mixing of fuel vapors to form a combustible mixture and to provide a combustion zone. A liquid fuel feed system, such as a gravity-fed system, or a capillary feed system employing a porous capillary feed wick or capillary tube(s), conveys liquid fuel from a fuel reservoir to the liquid feed surface of the porous member, which is generally at the "bottom" of the porous member. The liquid fuel feed system may be provided as an integral component of the porous member for certain applications. The heat source may be provided as a heating element using an external power source, or a portion of the heat generated by combustion may be returned to provide the heat required for vaporization. A substantially vapor impermeable barrier may be provided, for example, in the form of: (i) a vapor impermeable shroud positioned in proximity to porous member surfaces adjacent the liquid feed surface; in combination with (ii) a substantially vapor impermeable plate having one or more restricted passage(s) positioned in proximity to a porous member surface opposite the liquid feed surface.

According to especially preferred embodiments, the vapor impermeable shroud has a generally low thermal conductivity, while the substantially vapor impermeable plate has a generally high thermal conductivity. When the porous member is provided as a generally cylindrical or rectangular member, the liquid feed surface is generally the "bottom" surface, a vapor impermeable shroud is positioned in proximity to the porous member sidewalls, and a substantially vapor impermeable plate is positioned in proximity to the porous member "top" surface. The heat source may be provided at or near the "top" of the porous member, for example, as a thermally conductive element deriving heat from a source internal or external to the combustion apparatus. When this arrangement is employed, the vaporization zone of the porous member is in proximity to and generally "below" the heat source. One or more vapor permeable passage(s) are preferably provided in the substantially vapor impermeable plate to permit egress of one or more fuel vapor jet(s) under pressure. Pressurized fuel vapor jet(s) entrain air or another gas or gas mixture to produce a combustible fuel/gas mixture. The combustible fuel/gas mixture may be ignited and burned continuously or intermittently in a combustion zone of the burner assembly.

Certain embodiments of combustion apparatus of the present invention do not require priming or a discrete starter mechanism to initiate liquid fuel vaporization, pressurization and combustion. In one preferred combustion apparatus, heat applied briefly to the burner assembly by a match or lighter is conducted to the porous member and is sufficient to initiate liquid fuel vaporization on or within the porous member, leading to pressurization of the fuel vapor in the vaporization/pressurization module and combustion of the resulting combustible mixture. Once combustion is initiated, the heat for fuel vaporization and pressurization is preferably derived by returning a portion of the heat generated by combustion to the porous member, for example, through conductive elements forming a part of the burner in thermal communication with a hot seat having a high thermal conductivity. The hot seat is preferably located in proximity to and in thermal communication with both the porous member and the burner to transfer the heat energy necessary for fuel vaporization and pressurization from the burner to the porous member. According to preferred embodiments, a steady state condition can be achieved and maintained wherein liquid fuel provided to the liquid feed surface of the porous member at substantially ambient pressures and temperatures is heated and pressurized within the vaporization/pressurization module using a portion of the heat generated in the burner to produce one or more pressurized vapor jet(s), which in turn are used for combustion.

Vaporization/pressurization modules and liquid feed systems of the present invention may be scaled to provide a range of pressurized vapor outputs. For liquid fuel applications, vaporization/pressurization modules may also be used with controllable, variable output combustion apparatus. The combustion output may be varied in numerous ways and is most conveniently varied by adjusting the vaporized, pressurized fuel stream(s) exiting from the module. Adjustment of the vaporized, pressurized fuel stream may be accomplished, for example, by adjusting the amount of heat supplied to the module, by adjusting the flow of liquid fuel to the liquid feed surface of the porous member, or by limiting or adjusting the egress of vaporized fuel from the module. The flow of liquid fuel to the porous member may be regulated by restricting capillary flow through the porous member or, where an assembly of multiple individual modules is used, by removing a selected number of them from the liquid. The flow of pressurized vapor from the module may be regulated by providing a valve or a throttle, or other mechanical means. The quantity of heat supplied to the porous member may be varied, for example, by adjusting the power provided an electrical resistive heating element or by modulating the amount of heat returned to the vaporization/pressurization module from combustion.

Combustion apparatus may incorporate a plurality of individual vaporization/pressurization modules and/or an array of burners, each burner associated with one or more vaporization/pressurization modules, in applications requiring a higher heat or light output than a single module or burner can provide. In addition, modules and/or burners having different capacities may be arrayed together for use separately or in combination.

The vaporization/pressurization module liquid feed system and combustion apparatus may be adapted for use in applications requiring a heat or light source, and are especially suitable for use in applications in which a portable heat and/or light source is required. Such combustion apparatus may be used with a variety of liquid fuels, including fuels such as gasoline, white gas, diesel fuel, kerosene, JP8, alcohols such as ethanol and isopropanol, biodiesel, and combinations of liquid fuels. Vaporization/pressurization modules, liquid feed systems, and combustion apparatus of the present invention may be optimized for use with a particular liquid fuel source, or a single module feed system and combustion apparatus may be designed for use with multiple liquid fuels. The system is thus highly versatile and may take advantage of readily available fuels. The vaporization/pressurization module of the present invention may be used in connection with or used to retrofit any type of apparatus that requires the formation of a pressurized vapor jet from a liquid.

Combustion apparatus components other than the burner, the heat source, and the thermal path between the two remain cool to the touch during operation, and the liquid fuel need not be pressurized to provide a substantially continuous vaporized fuel jet during operation. The combustion apparatus of the present invention thus incorporates many safety features not available in other types of combustion apparatus. Moreover, combustion apparatus of the present invention may be miniaturized and constructed from lightweight materials. Simple embodiments of the combustion apparatus employing a vaporization/pressurization module, with or without a separate liquid feed system, may be designed to have few components, and no moving components. Such apparatus may be produced at a low cost and demonstrate improved reliability. They burn efficiently and "clean," and are not prone to clogging as a result of oxidation or pyrolosis of the liquid fuel.

Combustion apparatus incorporating vaporization/pressurization modules and liquid feed systems of the present invention are especially suitable for use as portable heaters, stoves and lamps for indoor, outdoor and/or marine applications, as well as power sources for use in a variety of devices, including absorption refrigerators and other appliances, and thermal to electric conversion systems, such as thermophotovoltaic systems, thermoelectric thermopiles, and alkali metal thermal to electric conversion (AMTEC) systems. Applications including outdoor, camping and marine stoves, portable or installed heaters, lamps for indoor or outdoor use, including mantle lamps, torches, "canned heat" for keeping food or other items warm, "canned light" as a replacement or supplement to candles or other light sources, and emergency heat and light "sticks" are just a few of the many applications for such combustion apparatus. Exemplary non-combustion applications of vaporization/pressurization modules of the present invention include steam generation apparatus and other types of apparatus for providing liquids in a vaporized, aerosol or atomized form.

DESCRIPTION OF PREFERRED EMBODIMENTS

Figure 1:
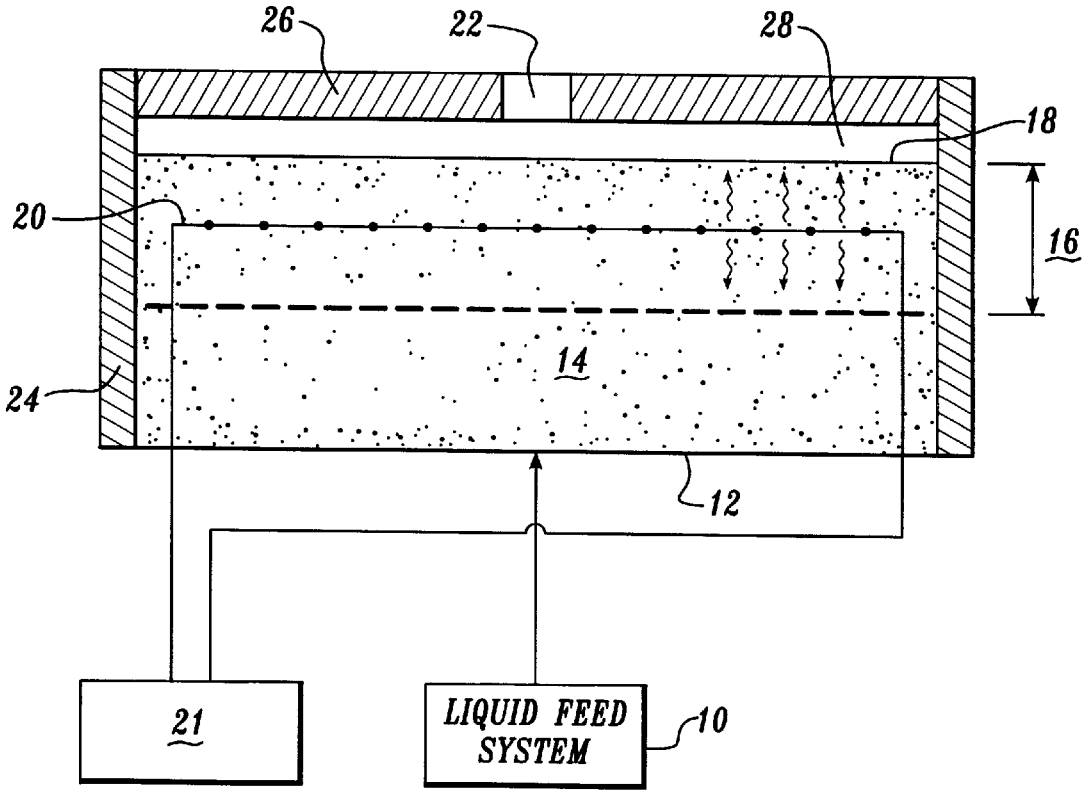
FIG. 1 is a schematic cross-sectional diagram illustrating a vaporization/pressurization module of the present invention comprising a porous member, a heat source and a substantially vapor impermeable barrier.

The liquid vaporization and pressurization apparatus and methods for vaporizing and pressurizing liquids of the present invention are described first with reference to the schematic illustration of FIG. 1. Liquid from a liquid feed system 10 is introduced to a liquid feed surface 12 of porous member 14. During operation of the vaporization/pressurization module, liquid feed system 10 preferably provides a continuous supply of liquid to liquid feed surface 12. While liquid feed surface 12 is illustrated in FIG. 1 as the "bottom" surface area of a cylindrical or rectangular porous member, it will be recognized that porous members of the present invention may be provided in a variety of configurations, and that the liquid feed surface may be provided in a variety of configurations as well as locations within or on the surface area of the porous member. Porous member 14 may also incorporate or be provided integrally with a liquid feed system.

As liquid is drawn into porous member 14, it is heated and vaporized at vaporization zone 16 within or on a surface of porous member 14 where the liquid is heated to its vaporization temperature. A heat source is preferably provided in thermal communication with porous member 14 to provide the heat necessary for liquid vaporization. In the embodiment illustrated in FIG. 1, the heat source comprises resistive heating element 20 electrically connected to power source 21 embedded in porous member 14. It will be recognized that numerous types of heat sources may be used and that such heat sources may be provided within, on a surface of, or otherwise in proximity to vaporization zone 16 or porous member 14. Vapor is produced on surfaces of and/or within porous member 14 and, in the embodiment illustrated in FIG. 1, vapor exits porous member 14 at vapor release surface 18.

One of the important features of the vaporization/pressurization module of the present invention is that liquid at ambient temperature and pressure is both vaporized and pressurized in the module to produce one or more pressurized vapor jet(s). The produced vapor is pressurized within the module as a consequence of the controlled or controllable egress of vapor from the substantially vapor impermeable barrier provided in proximity to the porous member at surfaces other than the liquid feed surface. The substantially vapor impermeable barrier, as illustrated in FIG. 1, is located in proximity to the surfaces of porous member 14 adjacent and opposite liquid feed surface 12, shown as the sidewalls and top of porous member 14. Egress of pressurized vapor jet(s) from the enclosed space formed by the substantially vapor impermeable barrier takes place at one or more vapor permeable passage(s), such as aperture 22.

The substantially vapor impermeable barrier illustrated in FIG. 1 is preferably provided as a vapor impermeable shroud 24 located adjacent to the porous member sidewalls and a separate substantially vapor impermeable plate or aperture plate 26, or similar structure located in proximity to vapor release surface 18, illustrated as the "top" of porous member 14 in FIG. 1. The substantially vapor impermeable barrier formed by the combination of shroud 24 and plate 26 isolates the surfaces of porous member 14 other than liquid feed surface 12 in a substantially enclosed or enclosable space. Shroud 24 is preferably vapor impermeable and is preferably arranged closely adjacent, and most preferably contacting, the sidewalls of porous member 14. Plate 26 is preferably provided as a substantially vapor impermeable barrier, is preferably provided with at least one vapor permeable passage, and is preferably in proximity to but spaced a distance from vapor release surface 18 of porous member 14 to form a vapor collection space or plenum 28.

The substantially vapor impermeable barrier may be provided in a variety of configurations and arrangements, depending upon the configuration and composition of porous member 14 and the environment or application in which the vaporization/pressurization module is used. The substantially vapor impermeable barrier is arranged to provide substantial constraint of porous member 14 and, preferably, to enclose the surfaces of porous member 14 other than liquid feed surface 12 in a substantially vapor impermeable fashion, while permitting egress of generated vapor at one or more predetermined locations at a pressure greater than that of the liquid feed.

According to an embodiment preferred for use in liquid fuel combustion applications, the substantially vapor impermeable barrier is provided as shroud 24, constructed from a rigid material having a generally low thermal conductivity, and plate 26, constructed from a rigid material having a generally high thermal conductivity. The generally low thermal conductivity of shroud 24 is sufficiently low to prevent a substantial portion of thermal energy from migrating from the vaporization zone toward liquid feed surface 12 of porous member 14. The thermal conductivity of shroud 24 is preferably less than about 200 watts per meter-Kelvin ("W/m K") and more preferably less than about 100 W/m K. The generally high thermal conductivity of plate 26 is sufficiently high to transfer the heat required for vaporization to the vaporization zone of the porous member. The thermal conductivity of plate 26 is preferably greater than about 200 W/m K, and more preferably greater than 300 W/m K. This arrangement promotes heat transfer to and within porous member 14 in proximity to vapor release surface 18 and vaporization zone 16, yet it advantageously minimizes heat transfer through porous member 14 between vaporization zone 16 and liquid feed surface 12, and into the liquid feed system and any liquid reservoir.

An important feature of the vaporization/pressurization module of the present invention is the "substantial constraint" of the porous member provided by the substantially vapor impermeable barrier, which facilitates pressurization of vapor generated within and/or on the surface of the porous member. Pressurization of produced vapor within the enclosed space formed by the substantially vapor impermeable barrier and subsequent release through one or more vapor permeable apertures is generally sufficient to form one or more vapor jet(s) having a pressure greater than the pressure at which the liquid was supplied, and is preferably sufficient to form one or more vapor jet(s) having a velocity sufficient to entrain and mix with a gas to form a combustible mixture without requiring introduction of energy from an external source. For most combustion applications, the vaporization/pressurization module produces a vapor jet having a pressure greater than atmospheric using liquid fuel supplied at atmospheric pressure. The vaporization/pressurization module of the present invention may alternatively use liquid supplied at a pressure greater than atmospheric to produce a vapor jet at a higher differential pressure.

"Substantial constraint" of the porous member, as that term is used herein, means that egress of produced vapor to a location remote from the vaporization/pressurization module is limited or controllable to produce one or more vapor jets at a pressure greater than atmospheric. Substantial constraint is generally provided by a substantially vapor impermeable barrier mounted in proximity to surfaces of the porous member other than the liquid feed surface. A substantially vapor impermeable barrier that provides "constrainable" egress of vapor may incorporate an adjustment feature such as a throttle or valve, or a variable size or number of apertures, or the like, to provide controllable vapor release from the vaporization/pressurization module, while providing constraint sufficient to pressurize vapor enclosed by the substantially vapor impermeable barrier. According to preferred embodiments, egress of pressurized vapor is physically limited by a substantially vapor impermeable barrier having locations permitting egress of pressurized vapor, the vapor permeable locations constituting less than about 5%, more preferably less than about 2%, and most preferably less than about 0.5% of the surface area of the substantially vapor impermeable barrier.

Porous member 14 preferably comprises a material having a low thermal conductivity and a substantially uniform pore size. The thermal conductivity of porous member 14 is preferably sufficiently low to maintain a thermal gradient from ambient temperature of liquid feed surface 12 to the temperature of vaporization at vaporization zone 16, and to prevent substantial heat transfer out of vaporization zone 16. Materials having a thermal conductivity of less than about 10 W/m K are suitable for porous member 14, materials having a thermal conductivity of less than about 1.0 W/m K are preferred, and materials having a thermal conductivity of less than about 0.10 W/m K are especially preferred. Fibrous materials such as fiberglass mats, other types of woven and non-woven fibrous materials, and porous ceramic, low conductivity porous or fibrous metallic materials and porous metal/ceramic composites are suitable. Suitable materials have a porosity sufficient to provide an adequate supply of liquid to the vaporization zone to provide the desired vapor output.

Porous member 14 may alternatively comprise a composite member composed of materials having different thermal conductivities. Such a composite porous member may, to for example, comprise a vaporization member having a generally high thermal conductivity in fluid communication with a liquid transfer member having a generally low thermal conductivity. The liquid transfer member in this embodiment may serve as a liquid feed system for the vaporization/pressurization module.

Porous member 14 comprises a material having a relatively small pore size that remains substantially constant during operation of the vaporization/pressurization module.

In general, smaller pore sizes generate greater capillary pressures and, consequently, higher vapor pressures can be generated. The pore size of porous member 14 is sufficiently small to provide an adequate supply of liquid to the vaporization zone to produce the desired vapor output and to provide the capillary forces necessary to maintain a discrete vaporization zone and at the same time, provide a porous environment for vaporization to occur in the vaporization zone. Average pore sizes of from less than 1 micron to about 50 microns are preferred, with average pore sizes of from 0.10 to 30 microns being more preferred, and average pore sizes of about 0.5 to 5 microns being especially preferred.

In the vaporization/pressurization module illustrated in FIG. 1, resistive heating element 20 is electrically connected to power source 21 and is provided in proximity to vaporization zone 16 of porous member 14. If a cylindrical or rectangular porous member is used, as shown, vaporization zone 16 is preferably located at or near vapor release surface 18, shown at the "top" of porous member 14. Heat source 20 is illustrated as a resistive heating element in communication with external power source 21 to provide a controllable amount of heat to vaporization zone 16. In alternative embodiments, a heat source may be provided in contact with or in proximity to vapor release surface 18 of porous member 14. Heat source 20 is preferably capable of providing heat in a generally uniform distribution over a surface or cross section of porous member 14.

During operation of the vaporization/pressurization module illustrated schematically in FIG. 1, liquid feed is introduced at ambient temperature and ambient pressure to liquid feed surface 12 of porous member 14 and is drawn into the porous member by capillary action. According to preferred embodiments, in which a substantially continuous pressurized vapor flow is provided during an operating cycle, liquid feed is preferably continuously introduced to liquid feed surface 12. The vaporization/pressurization module is "started" by activating heat source 20 and heating vaporization zone 16. As vaporization zone 16 is heated, a thermal gradient is established within porous member 14, with the hottest areas being in proximity to the heat source and vaporization zone, and the coolest areas being in proximity to liquid feed surface 12. Capillary forces convey liquid to vaporization zone 16, where the temperature corresponds to the liquid vaporization temperature. The vaporization zone is generally a locus of points or layer located at or near vapor release surface 18 of porous member 14 and, preferably, is at least partially within porous member 14.

As the vaporization zone is heated and vapor is generated, vapor pressure accumulates within the enclosed space formed by the substantially vapor impermeable barrier. Vapor is released, as a pressurized vapor jet, from one or more vapor permeable passages, such as aperture 22. The accumulation of vapor and heat tends to promote migration of the vaporization zone "downwardly" through porous member 14 toward liquid feed surface 12. Simultaneously, capillary forces draw ambient temperature and pressure liquid into the porous member at liquid feed surface 12 and toward the vaporization zone, thus stabilizing the location of the vaporization zone within porous member 14. The location of the vaporization zone within porous member 14, the degree of vapor pressurization, and amount of pressurized vapor released from the vaporization/pressurization module may be modulated, for example, by varying the pore size of the porous member, by providing porous members having different thermal conductivity properties, by changing the configuration or arrangement of porous member 14, by varying the number, size and/or location of vapor permeable apertures in the substantially vapor impermeable barrier, by modulating the amount of vapor released, and/or by adjusting the amount of heat provided to the vaporization zone. These parameters may likewise be adjusted and modified to provide adaptations that permit vaporization/pressurization modules to efficiently vaporize many different liquids.

One of the important applications for a vaporization/pressurization module of this type is vaporizing and pressurizing liquid fuels to produce a combustible fuel mixture. Several different types of exemplary combustion apparatus are described in detail below. It will be recognized, however, that the vaporization/pressurization module of the present invention may be used in numerous applications that involve liquids other than liquid fuels.

The vaporization/pressurization module and liquid feed system of the present invention and associated combustion apparatus will be described first with reference to FIGS. 2–4. It will be recognized that the embodiments illustrated and described herein are illustrative, and that the vaporization/pressurization module and liquid feed system of the present invention may be adapted for use with and employed in numerous types of combustion devices.

Figure 2:
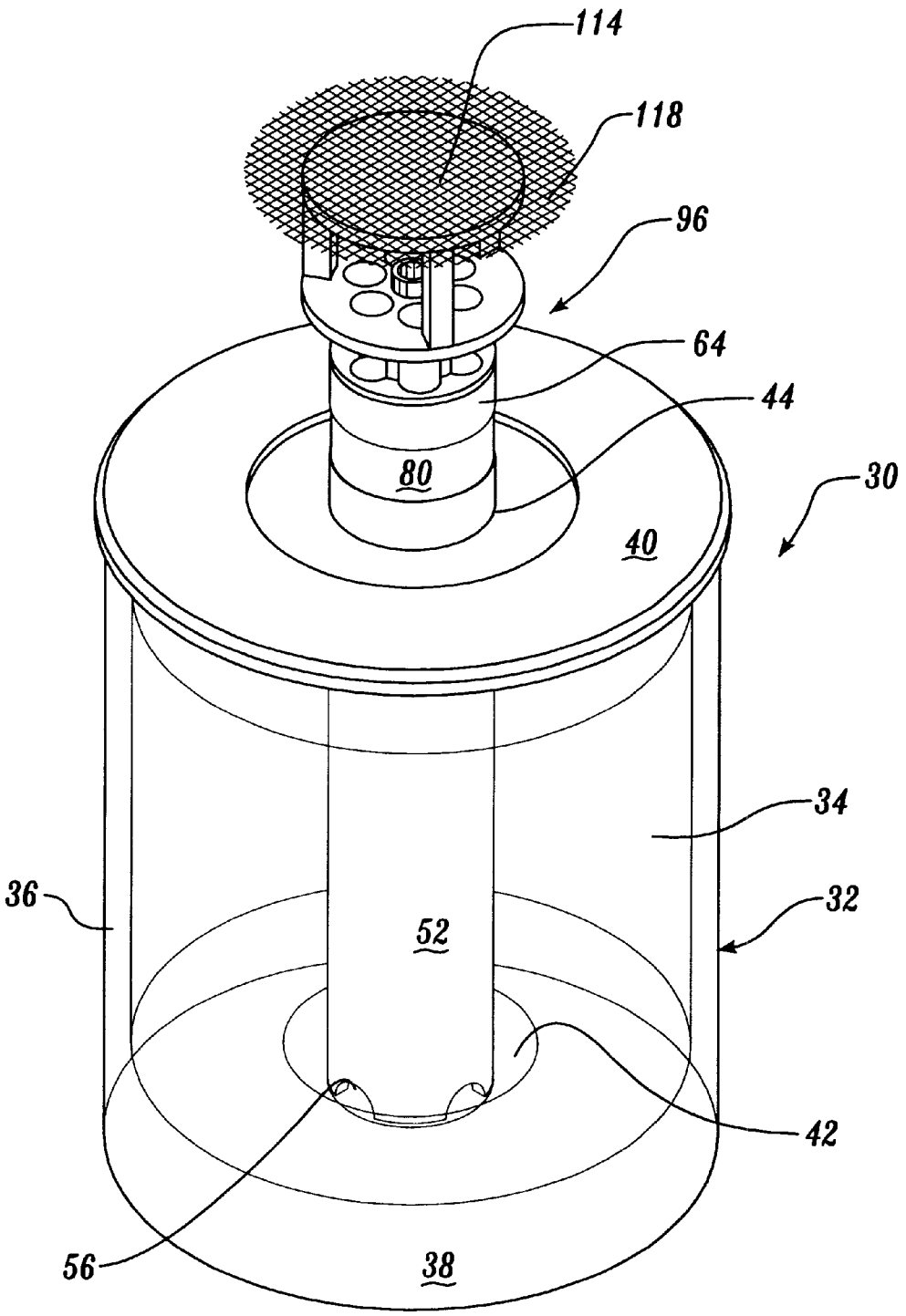
FIG. 2 shows a perspective view of a combustion apparatus utilizing a vaporization/pressurization module and liquid feed system of the present invention.
Figure 3:
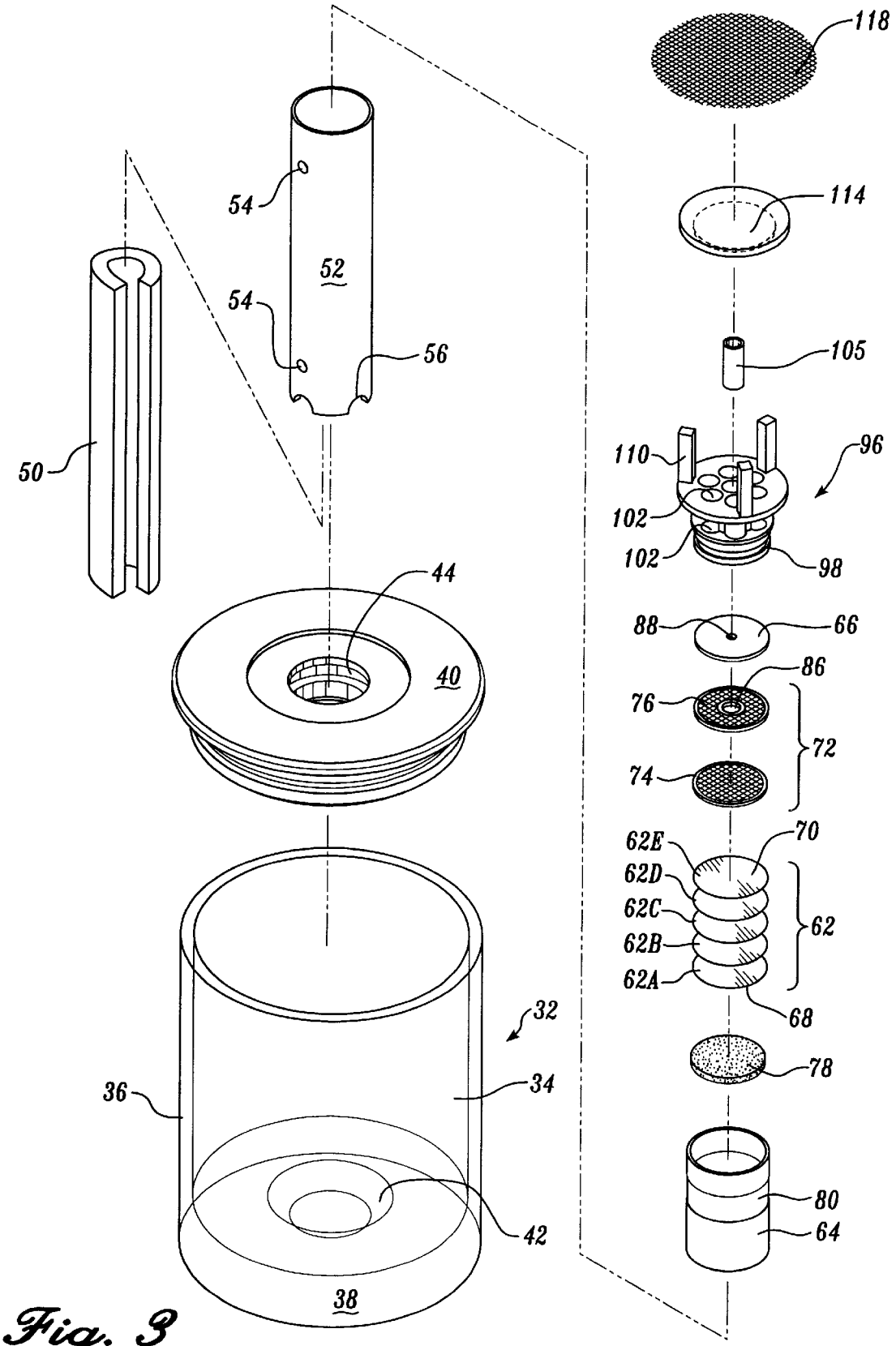
FIG. 3 shows a perspective, exploded view of the components of the combustion apparatus illustrated in FIG. 2.
Figure 4:
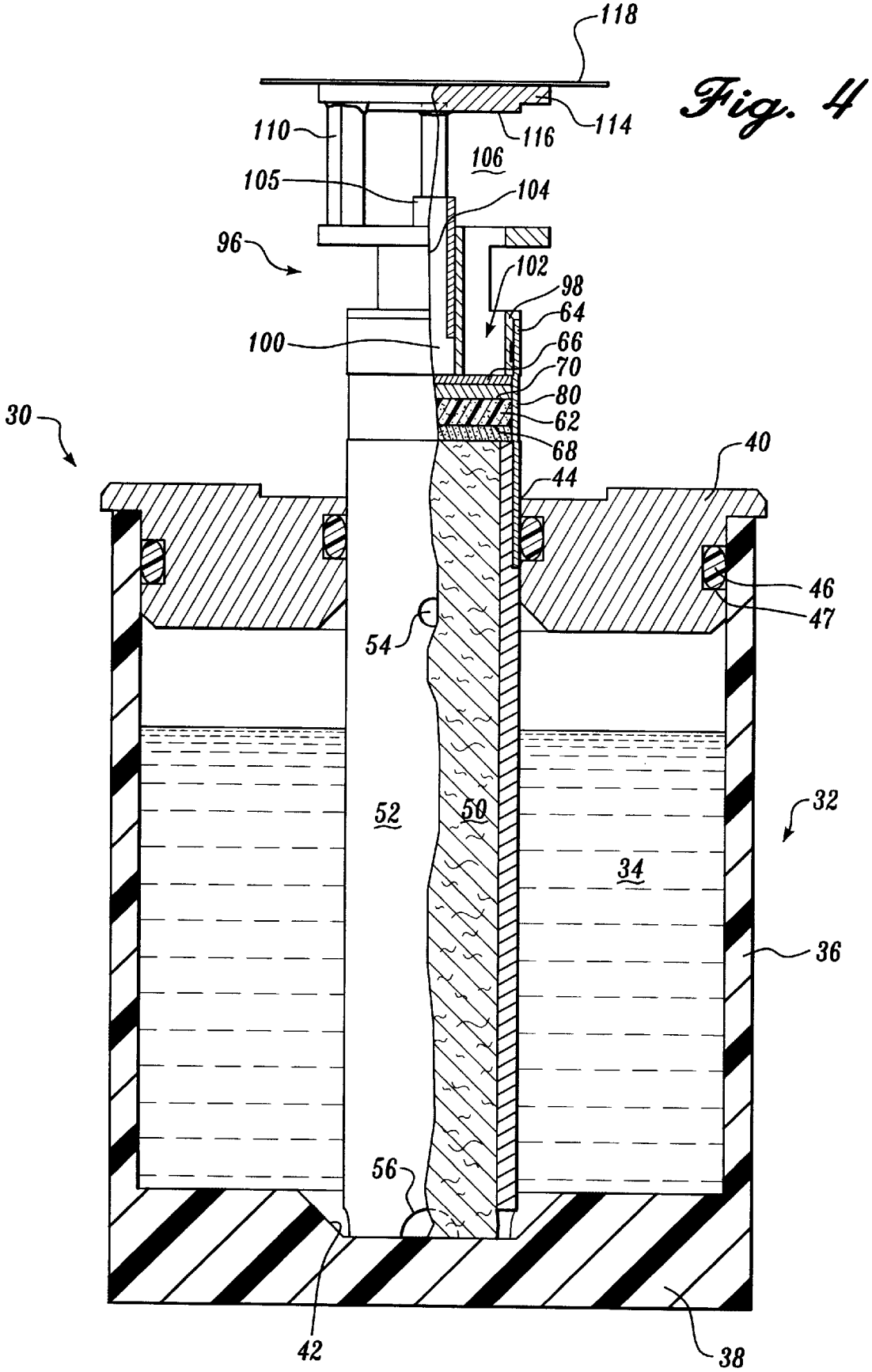
FIG. 4 shows a cross-sectional view of a combustion apparatus utilizing a vaporization/pressurization module and liquid feed system similar to the apparatus shown in FIGS. 2 and 3.

The combustion apparatus employing the vaporization/pressurization module of the present invention illustrated in FIGS. 2–4 incorporates a liquid fuel reservoir and liquid feed system of the type which is preferred for many applications. Combustion apparatus 30 comprises a liquid fuel container 32 providing an enclosed ambient pressure fuel reservoir 34. Liquid fuel container 32 may be provided in a variety of configurations, and may be in proximity to or remote from the other combustion apparatus components. Liquid fuel container 32 is preferably vented to the atmosphere to ensure that the pressure within container 32 is equalized with ambient pressure during operation of the combustion device. Venting may be provided in numerous ways which are well known in the art.

According to a preferred embodiment, liquid fuel container 32 is cylindrical and comprises a continuous, cylindrical sidewall 36, an end wall 38 and an opposite end wall 40. End wall 38 may incorporate a depression 42, as shown, to facilitate the flow of liquid fuel to the fuel delivery system. End wall 40 may be provided with an aperture 44 for receiving a liquid fuel feed system or another component of the associated combustion apparatus. Side wall 36 and bottom wall 38 are preferably constructed from a rigid, durable material that is impermeable to liquids and gases, and that does not react with the liquid fuel. According to a preferred embodiment, side wall 36 may be constructed from a material that is transparent or translucent, so that the liquid fuel level is visible to the user. Various types of thermoplastic materials, such as polymeric plastic materials, acrylic, polypropylene, and the like are suitable.

For some combustion applications, a fuel reservoir may be provided remote from the vaporization/pressurization module and combustion apparatus, with a fuel feed line or liquid fuel feed system feeding liquid fuel to the vaporization/pressurization module. For many combustion applications, the fuel reservoir is conveniently and desirably in proximity to the vaporization/pressurization module, as shown in FIGS. 2–4. In either event, means for refilling the fuel reservoir with liquid fuel is generally provided. In a combustion apparatus of the type illustrated in FIGS. 2–4, a sealable hole may be provided, for example, in end wall 40 of liquid fuel container 32 or, as shown in FIG. 3, end wall 40 of the liquid fuel container may be threadedly engageable with the fuel reservoir and thus be removable from the rest of the container for refilling fuel reservoir 34 with liquid fuel. Alternatively, end wall 40 may be detachable from and sealable against side wall 36 by means of O-ring 46 retained in groove 47, as illustrated in FIG. 4. Various types of refillable containers may be used. For applications where the combustion apparatus is intended to be portable, such as portable heating and lighting applications, the combustion apparatus is preferably designed to prevent or minimize spillage of liquid fuels from the fuel reservoir. This may be accomplished using various techniques which are well known in the art.

In a preferred embodiment, liquid fuel is delivered to the vaporization/pressurization module from liquid fuel reservoir 34 by means of a liquid fuel feed system. The liquid fuel feed system is capable of delivering liquid fuel substantially continuously during operation of the combustion apparatus and at a volume sufficient to sustain the desired level of combustion. Many types of liquid fuel feed systems are known in the art and would be suitable for use in combustion apparatus of the present invention. The liquid fuel feed system may be integral with the vaporization/pressurization module or the porous member, or may be provided as a separate component. Capillary liquid fuel feed systems are preferred. The feed system may comprise one or a plurality of capillary tubes, or a porous material, for example, that is immersed in or substantially fills the fuel reservoir. A preferred system, illustrated in FIGS. 2–4, comprises a porous feed wick 50 having a low thermal conductivity retained in a feed wick shroud 52. Feed wick 50 absorbs and conveys liquid fuel by capillary action. Numerous absorbent, porous materials, including cotton, fiberglass, and the like, are known in the art and would be suitable. A porous material marketed by E.I. duPont de Nemours & Co., of Wilmington, Del., as "NOMEX" is a preferred material. Porous feed wick 50 has a pore size and porosity to provide a liquid supply to the porous member sufficient to produce the desired vapor output. If porous feed wick 50 is a separate component, it preferably comprises a material having a relatively large average pore size, generally up to at least 10 times greater than the average pore size of the porous member in the vaporization/pressurization module.

Many absorbent porous materials that would be suitable for use as a feed wick stretch to a greater degree in one direction than in others. The low stretch direction of such materials is preferably aligned with the longitudinal axis of the feed wick. The dimensions and placement of feed wick 50 are such that fuel is absorbed and conveyed to the vaporization/pressurization module regardless of the level of liquid fuel in fuel reservoir 34.

Feed wick 50 is preferably retained in feed wick shroud 52, which may be separate from or integral with the substantially vapor impermeable barrier that constrains the porous member forming the vaporization/pressurization module. Feed wick shroud 52 is preferably constructed from a rigid, gas and liquid impermeable material that is non-corrosive in liquid fuels and has a generally low thermal conductivity. Aluminum, stainless steel, titanium alloys and ceramic materials are preferred. Feed wick shroud 52 is conveniently provided in a cylindrical form and preferably has at least one vent in proximity to each end providing communication between feed wick 50 and liquid fuel reservoir 34. More particularly, at least one vent is preferably provided in proximity to the interface of the feed wick with the porous member in the vaporization/pressurization module. The vents prevent trapped air and gas pockets from interfering with fuel flow in the feed wick. Vents are conveniently provided as apertures 54 in feed wick shroud 52, as illustrated in FIG. 3.

In the combustion apparatus illustrated in FIGS. 2–4, feed wick shroud 52 is received through aperture 44 in end wall 40 of fuel container 32. The end of feed wick shroud 52 is positioned in proximity to depression 42. Cutouts 56 may be provided in feed wick shroud 52, as shown in FIG. 2, to facilitate fuel flow to porous feed wick 50. The other end of porous feed wick 50 is in fluid communication with the vaporization/pressurization module.

Vaporization/pressurization module 60, as illustrated in FIGS. 3 and 4, comprises porous member 62, vapor impermeable shroud 64, and substantially vapor impermeable aperture plate 66. Porous member 62 is preferably cylindrical and may comprise a plurality of porous member layers 62A–62E, as illustrated in FIG. 3, or a single porous layer 62, as illustrated in FIG. 4. If a plurality of layers is employed, each of the layer interface surfaces closely contact(s) the adjacent layer interface surface substantially without gaps or voids. The number and thickness of individual porous member layers may vary, provided that the desired overall porous member thickness and a substantially uniform average pore size is provided. The preferred configuration and dimensions of porous member 62 varies depending, for example, on the desired vapor output.

Porous member 62 has a liquid feed surface 68 and a vaporized fuel exit surface 70. Liquid feed surface 68 is in fluid communication with the liquid fuel feed system and may contact the liquid fuel feed system directly or through one or more intermediate components. A vaporization zone is established within porous member 62 during operation. The vaporization zone is in thermal communication with a heat source, such as a hot seat, and may contact the heat source directly or through one or more intermediate components. In the embodiment illustrated in FIGS. 3 and 4, hot seat assembly 72 comprises first vapor permeable member 74 and second vapor permeable member 76, and is positioned in proximity to vaporized fuel exit surface 70 of porous member 62. Hot seat assembly 72 is in thermal communication with burner assembly 96 and provides heat to porous member 62 using a portion of the returned combustion heat. Temperature and pressure gradients are maintained across porous member 62 between the liquid feed surface 68 and vaporized fuel exit surface 70 during operation of the module, as described previously with respect to the vaporization/pressurization module illustrated in FIG. 1.

A glass fiber filter material without binders distributed by Millipore as APFC 090 50 having a pore size of $1.2\mu$ is an especially preferred material for porous member 62. Other porous materials having a low thermal conductivity and generally uniform average pore size, such as porous ceramic or porous metallic materials, as well as composites and woven and non-woven fiber materials, would be suitable. The desired configuration, e.g. thickness, of porous member 62 depends upon the desired output capacity of the combustion apparatus, the type of liquid fuel utilized, and the like.

Porous member 62 desirably has a substantially constant and uniform pore size throughout its volume. When porous member 62 comprises a non-rigid material or a material that is prone to stretching or otherwise changing its conformation, a rigid, liquid permeable porous member retainer 78 may be used to provide mechanical support for porous member 62. When porous member retainer 78 is employed, it is important to maintain efficient fluid communication between the liquid feed system and liquid feed surface 68 of porous member 62. Porous member retainer 78 preferably contacts the liquid feed surface 68 of porous member 62 closely and substantially without gaps and voids. Porous member retainer 78 comprises a porous, liquid permeable rigid material having a low thermal conductivity. Sintered bronze is an exemplary suitable material.

Porous member 62 is retained within vapor impermeable shroud 64. The edges of porous member 62 lie closely adjacent and preferably contact the inner surface of shroud 64 substantially without gaps and voids. The space between the edge(s) of porous member 62 and the inner surface of shroud 64, at any point along the interface, is desirably not greater than the average pore size of porous member 62. Shroud 64 comprises a rigid, liquid and gas impermeable material having a generally low thermal conductivity, as described above. In the embodiments shown in FIGS. 2–4, shroud 64 has a thin-walled section 80 in which the porous member is retained. Thin-walled section 80 is provided to reduce the thermal conductivity of shroud 64 where it interfaces with porous member 62, thereby reducing and minimizing heat transfer via shroud 64 through porous member 62. Thin-walled section 80 is desirably as thin as is practical without compromising the structural integrity of shroud 64. Stainless steel is a preferred material for shroud 64, although many other materials having a low thermal conductivity, such as titanium alloys, are suitable.

Vaporized fuel exit surface 70 of porous member 62 is preferably in proximity to and in thermal communication with a heat source providing heat energy for vaporizing the liquid fuel in or at the surface of the porous member. The heat source may employ an external power source, such as the electrical heating element illustrated in FIG. 1. Alternatively and preferably, the heat source utilizes heat energy returned from the heat of combustion without requiring any input from or connection to an external power source.

According to a preferred embodiment illustrated in FIGS. 3 and 4, the heat source comprises a hot seat assembly 72 comprising a first vapor permeable member 74 and a second vapor permeable member 76. First vapor permeable member 74 of hot seat assembly 72 is in thermal communication with porous member 62 directly or through one or more intermediate components to deliver heat in a substantially uniform distribution over vaporized fuel exit surface 70 of porous member 62. Second vapor permeable member 76 is in thermal communication with first member 74 and a heat return means providing heat from combustion of the vaporized fuel.

Figure 5A:
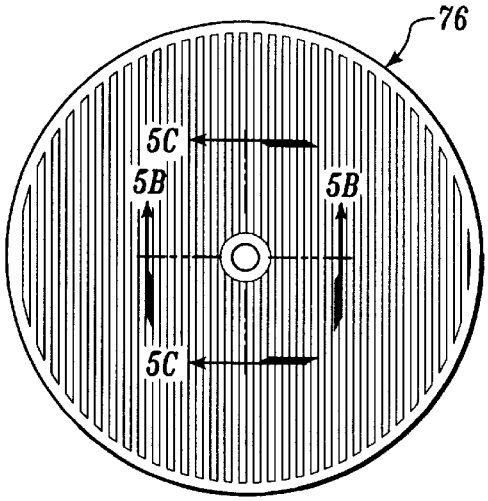
FIGS. 5A, 5B and 5C show enlarged plan and cross-sectional views of a preferred hot seat for use in the combustion apparatus of the present invention, with FIG. 5A illustrating an enlarged plan view, FIG. 5B illustrating a cross-sectional view taken along line 5B—5B of FIG. 5A, and FIG. 5C illustrating a cross-sectional view taken along line 5C—5C of FIG. 5A.
Figure 5B:
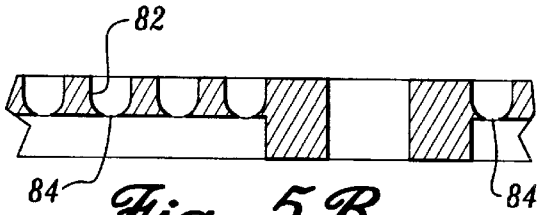
Figure 5C:
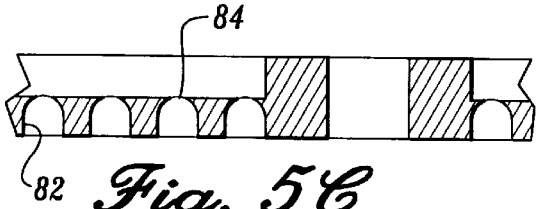

Hot seat assembly 72 comprises one or more members constructed from a vapor permeable material having a generally high thermal conductivity. In the preferred embodiment illustrated in FIGS. 5A, 5B and 5C, each member of hot seat assembly 72 preferably has a three dimensional surface for rapid and efficient heat and fuel vapor collection and transfer. Each surface of vapor permeable members 74 and 76 has a plurality of parallel grooves 82. Parallel grooves 82 formed on opposing surfaces are provided at generally right angles to one another. Grooves 82 on each surface penetrate approximately 50% of thickness of members 74 and 76, such that through holes 84 are formed where the grooves formed on opposing surfaces intersect. Through holes 84 provide the desired vapor permeability and grooves 82 provide a collection area in which vapor is pressurized. Second vapor permeable member 76, which is in proximity to aperture plate 66, is preferably provided with one or more apertures 86 that assist in directing vaporized fuel to aperture 88 in aperture plate 66. Hot seat assembly 72 may be constructed, for example, from copper or a copper alloy, or another material having a high thermal conductivity, using a chemical milling process to form the grooves and through holes providing the desired vapor collection and permeability.

Porous member retainer 78, porous member 62, and hot seat assembly 72 are preferably mounted in a fixed position within shroud 64. Aperture plate 66, together with shroud 64, forms the substantially vapor impermeable barrier that substantially constrains egress of vapor and encloses surfaces of porous member 62 other than liquid feed surface 68. Aperture plate 66 is preferably spaced a distance from the vaporized fuel exit surface 70 of porous member 62 to provide additional space in which vapor is pressurized. Intermediate components, such as hot seat assembly 72, may occupy all or some of a space or plenum formed between aperture plate 66 and porous member 62.

Figure 6A:
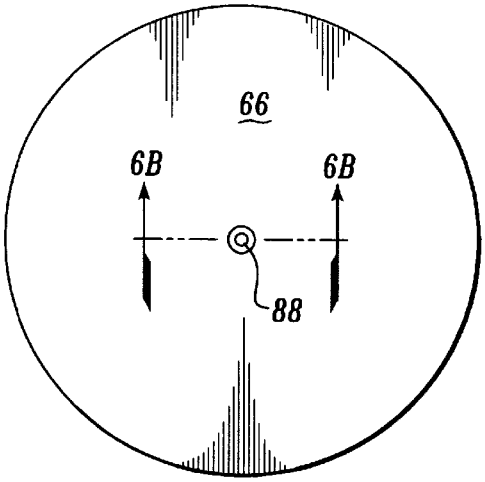
FIG. 6A shows an enlarged plan view of a preferred substantially vapor impermeable plate or aperture plate for use in the combustion apparatus of the present invention.
Figure 6B:
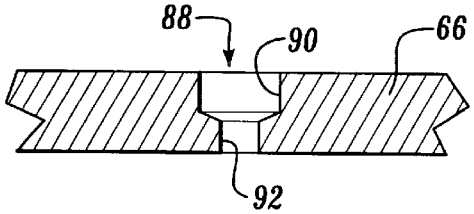
FIG. 6B shows a cross-sectional view of the aperture plate taken along line 6B—6B of FIG. 6A.

Aperture plate 66 is preferably provided in proximity to second vapor permeable member 76 of hot seat assembly 72. Aperture plate 66 has one or more vapor permeable location (s), such as aperture(s) 88, through which pressurized fuel vapor passes to produce one or more vaporized fuel jet(s). The size and placement of aperture(s) 88 in aperture plate 66 are important variables affecting the vaporization and pressurization of liquid fuel with the vaporization/pressurization module and desirably vary for different combustion applications, different types of porous members, and different types of fuels. FIGS. 6A and 6B illustrate a preferred aperture plate 66 wherein aperture 88 has a larger diameter portion 90 that tapers to form a smaller diameter portion 92 from which the vaporized fuel jet is released. Such tapered orifices generally assist in forming the vaporized fuel jet. Aperture plate 66 is preferably constructed from a rigid material having a generally high thermal conductivity, such as copper or copper alloy.

Burner assembly 96 is mounted in proximity to aperture plate 66 and provides one or more chamber(s) for mixing of air or another combustible gas or mixture with the vaporized fuel. Burner assemblies having various configurations may be used.

Burner assembly 96 illustrated in FIGS. 3 and 4 has a neck 98 which fits within and is retained by shroud 64. Burner assembly 96 has a mixing chamber 100 penetrated by one or more combustion gas supply channels 102. For many applications, the combustion gas is simply ambient air. A plurality of combustion gas supply channels 102 are preferably arranged radially in neck 98 for directing air into mixing chamber 100. Air for mixing with the vaporized fuel may be provided at ambient temperature and pressure or, for particular applications, may be provided at an elevated temperature and/or pressure. The air/vaporized fuel mixture exits mixing chamber 100 through a central passageway 104 and enters combustion zone 106. A mixer tube 105 may be provided in connection with central passageway 104 to direct the flow of the air/vaporized fuel mixture. Burner assembly 96 preferably supports two or more heat conductive posts 110. Apertures facilitate the flow of air into and through supply channels 102 and facilitate the flow of the air/vaporized fuel mixture to mixing chamber 100. Burner assembly 96 is preferably constructed from a rigid material having a generally high thermal conductivity, such as copper or a copper alloy. Burner assemblies of various configurations may be used.

Additional mixing of the air/vaporized fuel mixture takes place in combustion zone 106. Burner cap 114 is preferably mounted on conductive posts 110, and collision and ignition of the air/vaporized fuel mixture takes place on underside 116 of burner cap 114. Burner cap 114, in combination with flame spreader 118, spreads and distributes the flame. Burner cap 114 is preferably constructed from a rigid, substantially non-porous material such as stainless steel, and flame spreader 118 may comprise a stainless steel wire screen. In the combustion apparatus 30 illustrated in FIGS. 2–4, feed wick 50, porous member retainer 78, porous member 62, hot seat assembly 72, aperture plate 66, and burner assembly 96 all have a generally cylindrical or circular configuration and are arranged in a vertically stacked arrangement, aligned on a common central axis.

Combustion apparatus of the type illustrated in FIGS. 2–4 return a portion of the heat generated by combustion to the porous member to sustain vaporization of the liquid fuel and production of one or more vaporized fuel jet(s) to provide continuous, steady state operation of the combustion apparatus. According to this preferred embodiment, heat from combustion is conducted to porous member 62 from flames or heat generated on burner cap 114 through heat conductive posts 110, through burner neck 98 to aperture plate 66 and hot seat assembly 72. All of these components are constructed from materials having a high thermal conductivity. In this fashion, following initial vaporization and ignition of the combustible mixture, the combustion apparatus operates in a continuous, steady state mode without requiring introduction of heat or energy from any source external to the apparatus. Numerous other means for returning a portion of the heat generated by combustion to the vaporization/pressurization module are known in the art and would be suitable for use in connection with combustion apparatus of the present invention.

The combustion apparatus illustrated in FIGS. 2–4 does not require priming or any starter or discrete ignition mechanism to initiate combustion. Heating the burner assembly for a few seconds using a match or a lighter provides sufficient heat transfer to the hot seat and porous member to initiate vaporization and pressurization of fuel in the porous member, produce a vaporized fuel jet, and initiate combustion. This system has many advantages for portable burner applications. Various ignition systems, including catalytic ignition systems, may alternatively be adapted for use in combustion apparatus of the present invention.

Combustion apparatus of the type illustrated in FIGS. 2–4 may additionally incorporate an adjustable combustion output feature. The combustion output is generally modulated by increasing or decreasing the flow of vaporized and pressurized fuel into the burner assembly. Adjusting the fuel output may be accomplished in numerous ways. A preferred system for modulating the vaporized fuel output involves modulating the heat flux in the combustion apparatus, and more particularly involves modulating the amount of heat energy returned to the vaporization/pressurization module. Modulating the amount of heat returned may be accomplished, for example, by increasing or decreasing the number or capacity of heat return elements, such as conductive posts; by adjusting the position of the heat return elements with respect to the flame generated; by adjusting the flame pattern and/or content relative to the heat return element(s); by adjusting the amount of heat conducted by heat return elements, for example, by employing duty cycles, diverting a portion of the heat, or cooling a portion of the heat return elements; or by other methods that are known in the art.

Figure 7:
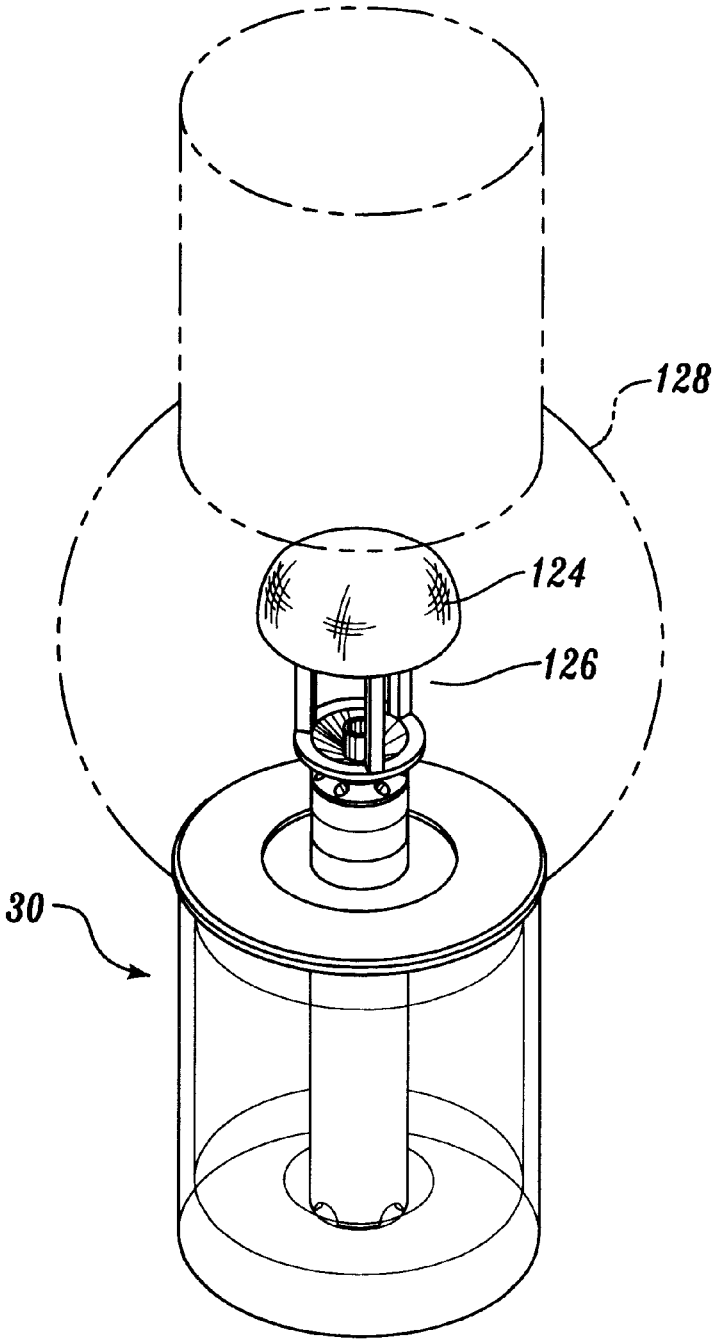
FIG. 7 shows a schematic perspective view of a combustion apparatus of the present invention in the form of a mantle lamp.

FIG. 7 schematically illustrates a combustion apparatus 30 of the present invention in the form of a mantle lamp. The mantle lamp comprises a combustion apparatus of the general type shown in FIGS. 2–4 with a mantle 124 mounted on a mantle support 126 in proximity to the flame. The shape of the flame may be adjusted by modifying the configuration of the burner, for example, to provide optimal mantle illumination output. Various types of mantles, such as "bag" mantles produced and sold by Coleman Co., Inc. of Witchita, Kans., rare earth doped rigid ceramic durable mantles, and the like, are suitable. Substantially rigid mantles are preferred due to their resistance to shock and handling. The combustion output, and thus the illumination output, may be varied, for example, as described above. In addition, the mantle may be movable with respect to the burner and flame to modulate illumination output. A chimney 128, reflectors, and other types of accessories may also be incorporated.

Figure 8:
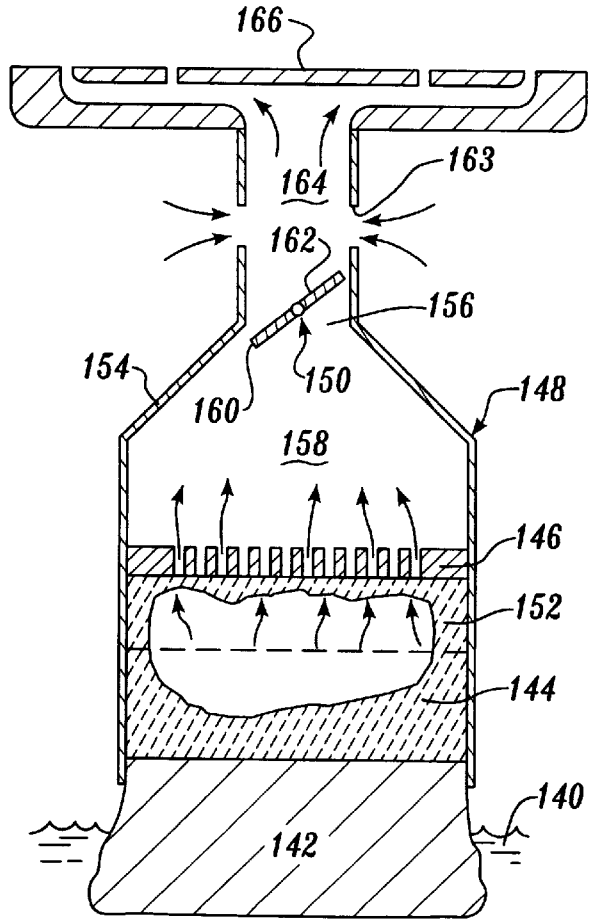
FIG. 8 shows a cross-sectional elevation view of an alternative embodiment of a combustion apparatus employing a vaporization/pressurization module and liquid feed system of the present invention in which the egress of pressurized vapor from the module is variable and controllable.

FIG. 8 illustrates another embodiment of a combustion apparatus of the present invention wherein the flow of vapor from the vaporization/pressurization module is adjustable by mechanical means. Liquid fuel 140 is conveyed from a reservoir through a capillary feed member 142 to a lower surface of porous member 144. Vapor permeable hot seat 146 is provided in proximity to an upper surface of porous member 144 for heating liquid fuel to its vaporization temperature. Hot seat 146 may be controllably heatable by an external energy source or may be heated from a portion of the returned combustion heat.

In the combustion apparatus illustrated in FIG. 8, porous member 144 is substantially constrainable at surfaces other than the liquid feed surface by means of substantially vapor impermeable shroud 148 and throttle 150. Shroud 148 comprises a cylindrical portion 152 and a conical portion 154 that tapers to form a vapor release aperture 156. Shroud 148 in communication with throttle 150 forms an enclosable space 158 which facilitates the accumulation and maintenance of vapor pressure during operation of the combustion device. Release of pressurized fuel vapor through vapor release aperture 156 is preferably adjustable by means of throttle 150, which may conveniently comprise a plate 160 matching the configuration of vapor release aperture 156, plate 160 being pivotable about pivot axis 162 to adjust the flow of vapor from enclosed space 158.

During operation of the combustion apparatus shown in FIG. 8, liquid fuel is vaporized in porous member 144 and fuel vapor exits the porous member, travels through hot seat 146, and collects in enclosed space 158. Adjustment of throttle 150 varies the flow and velocity of vapor to mixing chamber 164 and consequently varies the pressure at which vapor is released. Vaporized fuel mixes with air introduced through apertures 163 in mixing chamber 164 to form a combustible mixture that may be ignited and burned in burner 166.

Figure 9:
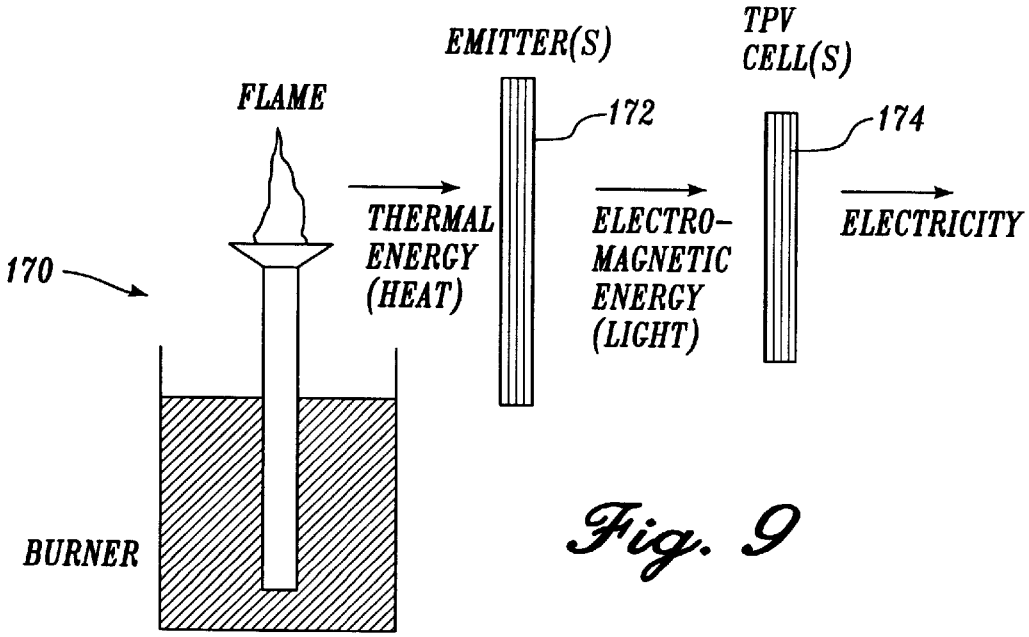
FIG. 9 schematically illustrates the use of a combustion apparatus of the present invention in a thermophotovoltaic system.

FIG. 9 schematically illustrates a liquid fuel burner apparatus of the present invention in a thermal to electric conversion system employing a thermophotovoltaic system to convert thermal energy to electrical energy. Liquid fuel combustion apparatus 170 employs a vaporization/pressurization module of the present invention to produce thermal energy, which is converted to radiant electromagnetic energy by emitter(s) 172. Suitable emitters are generally ceramic and may be doped with rare earth oxides. Electromagnetic energy emitted from emitter(s) 172 is converted to electricity in suitable thermophotovoltaic cell(s) 174. Suitable thermophotovoltaic cells include, for example, crystalline silicon cells, gallium antimonide (GaSb) infrared-sensitive cells, cells employing germanium, certain Group III-V materials such as gallium indium arsenide, and the like.

Figure 10:
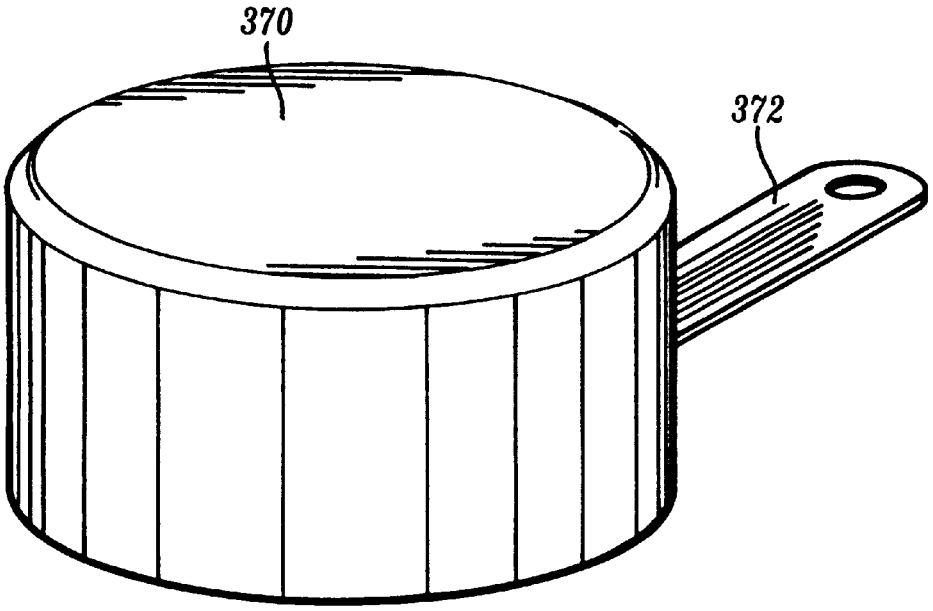
FIG. 10 shows a perspective representational view of another embodiment of a vaporization/pressurization module and liquid feed system of the present invention in a camp stove.
Figure 10:
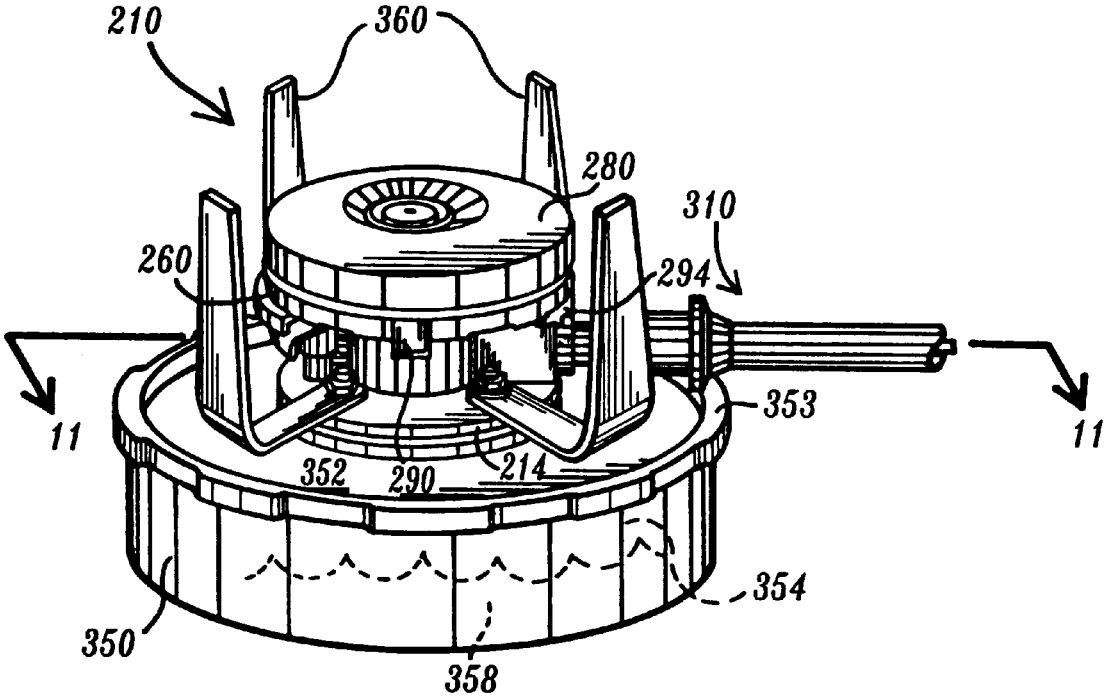
Figure 11:
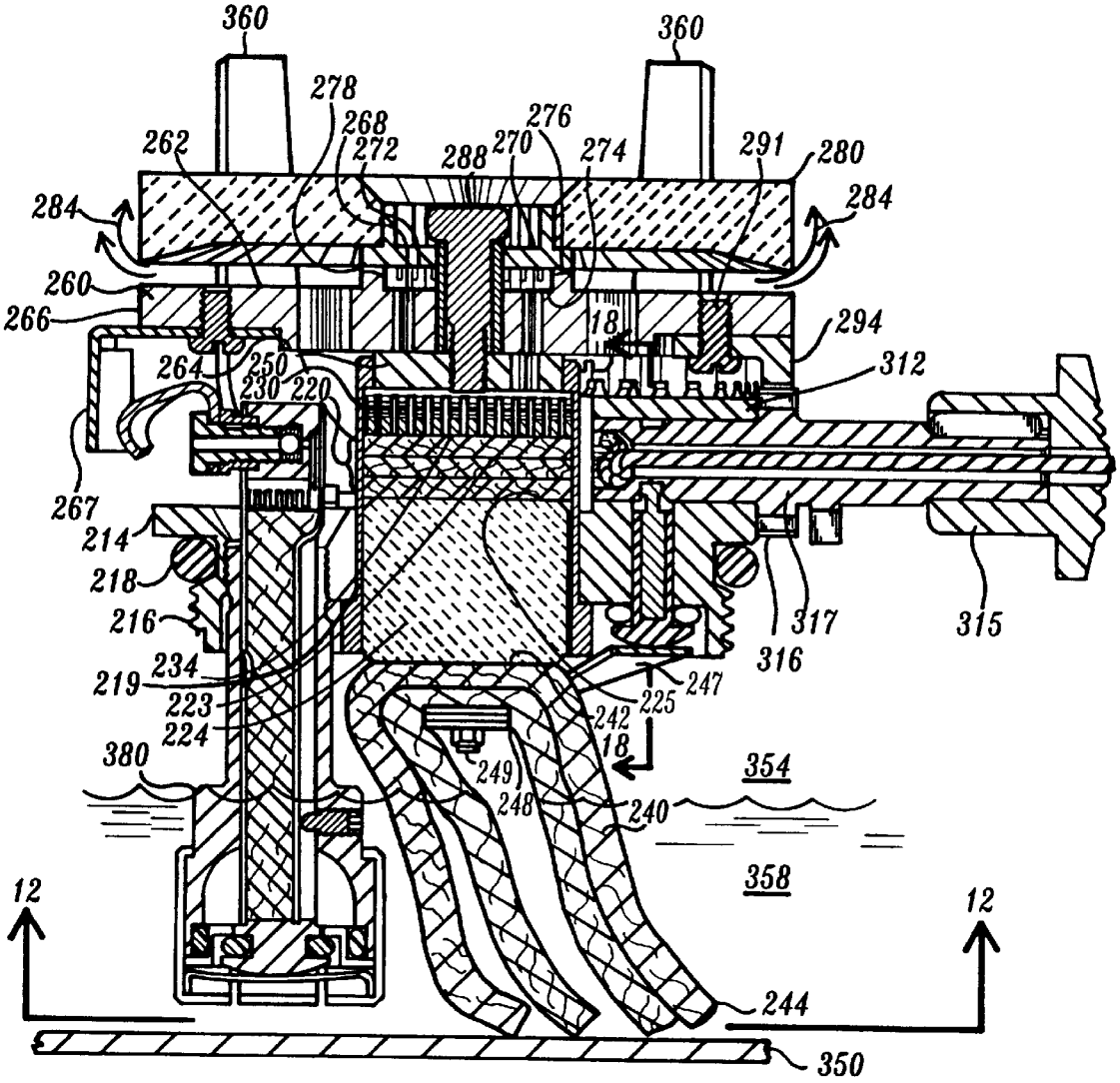
FIG. 11 is a cross sectional view along line 11—11 of FIG. 10.
Figure 12:
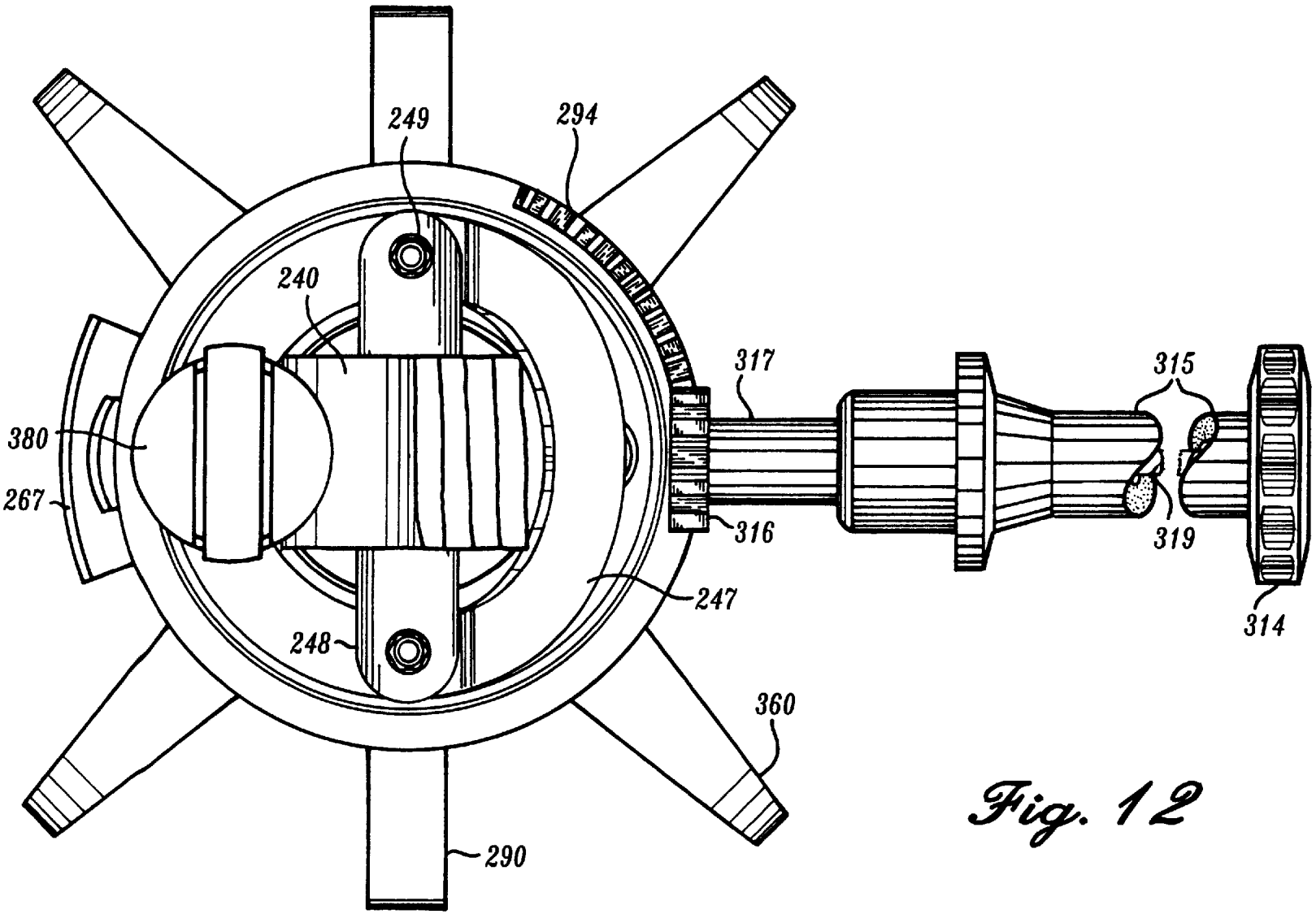
FIG. 12 is a bottom plan view along line 12—12 of FIG. 11.

Alternative embodiments of the vaporization/pressurization module, liquid feed system and combustion apparatus and accessory components arranged to provide a stove are illustrated in FIGS. 10–22. Referring first to FIGS. 10 and 11, fuel reservoir 350 is a tank for holding liquid fuel 358. Fuel reservoir lid 352, having lip 353 and carrying boiler frame 214 and associated apparatus, provides an air-tight closure to fuel reservoir 350. Boiler frame 214 screws into fuel reservoir lid 352 by means of threads 216, with resilient O-ring 218 providing a fluid tight seal between boiler frame 214 and fuel reservoir lid 352. In the preferred embodiment, fuel reservoir 350, fuel reservoir lid 352, and boiler frame 214 are made of aluminum, which provides a light, sturdy structure. However, in other embodiments these parts could be formed of other materials.

Shroud 219 is an elemental cylindrical member which passes vertically through, and is supported by, boiler frame 214. Shroud 219 is made of a thin wall of solid material which is a poor conductor of heat. Shroud 219 houses fuel transfer wick 224, fuel boiler wick 220, hot seat 230, and aperture plate 250.

Referring now to FIGS. 10 through 16, the top 242 of supply wick 240 is pressed against the lower surface of transfer wick 224 by means of clips 248 and nuts 249. The ends 244 of supply wick 240 dangle freely submerged in liquid fuel 358. Supply wick 240 is made of Kevlar felt in the preferred embodiment, though other porous flexible materials or rigid porous materials, such as glass frit or ceramic may be utilized. Whatever material is used for supply wick 240, the pores should be of appropriate size to wick fuel 358 from fuel reservoir 350 from supply wick ends 244 up and out the top 242 through transfer wick 224 under capillary action and provide liquid fuel 358 to boiler wick 220 at the appropriate boiling pressures. It should be noted that in alternative embodiments, a portion of transfer wick 224 could be directly submerged in liquid fuel 358, obviating the need for supply wick 240.

Fuel boiler wick 220 is a disk shaped member compressed between the upper surface 225 of transfer wick 224 and the lower surface 234 of hot seat 230. In the preferred embodiment, boiler wick 220 is made of three discs of Kevlar felt. However, in other embodiments, boiler wick 220 may be made of other porous materials, such as ceramic, of appropriate pore size. Also, in other embodiments, boiler wick 220 may be of unitary, versus laminar, construction. Boiler wick 220 is designed to fit snugly within shroud 219 so that a seal is formed between circular edge 223 of boiler wick 220 and the inner surface of shroud 219, so that fluid flow will be through the pores through wicking and not through any edge gaps exceeding the average pore size of the boiler wick. Boiler wick 220 must be of appropriate pore size and material so that capillary action provides a supply of liquid fuel and so that heat transferred from hot seat 230 to the boiler wick provides for a boiling transition from liquid to fuel vapor over an appropriate range of temperatures and pressures. If the boiler wick 220 is made of a rigid, porous material, such as a ceramic or metal, a vapor tight seal between edge 223 and shroud 219 may be accomplished by precise manufacture, isometric seals, or by the use of caulking type adhesives. However, it may be more practical to construct boiler wick 220 of a pliable soft material such as plastic foam, conformable bat or felt, as in the preferred embodiment, which can be compressed into the needed sealing contact.

Transfer wick 224 is a generally cylindrical rigid member made of porous material with pore size compatible with that of supply wick 240 and boiler wick 220. In the preferred embodiment, transfer wick 224 is made of ceramic, though it may also be made of metal.

Figure 13:
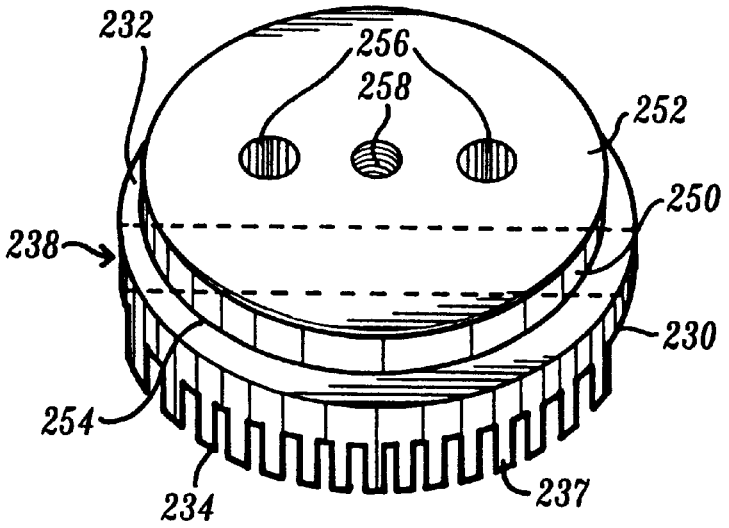
FIG. 13 is an isometric representational view of another embodiment of an aperture plate and hot seat of the present invention.

Referring specifically to FIG. 13, hot seat 230 and aperture plate 250 are generally cylindrical members formed or assembled as a unit. In the preferred embodiment, they are unitary in construction. The upper surface 232 of hot seat 230 forms an interface with the lower surface 254 of aperture plate 250. Both are formed of heat conductive materials, such as metals, for conducting heat from heat returns 290 through valve plate 260, and into boiler wick 220 for boiling the liquid fuel. Hot seat 230 and aperture plate 250 may be made of different materials, but in the preferred embodiment both are formed of aluminum.

Figure 14:
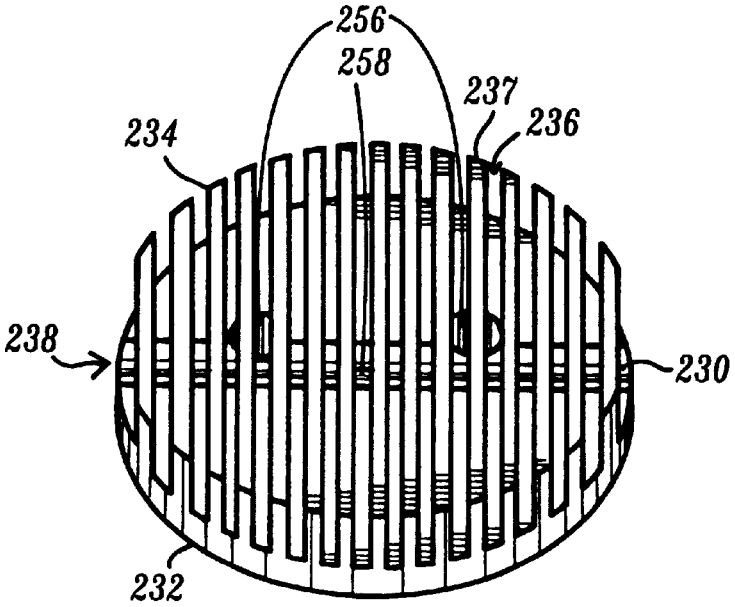
FIG. 14 is an isometric representational view showing the bottom face of one embodiment of a hot seat of the invention.
Figure 15:
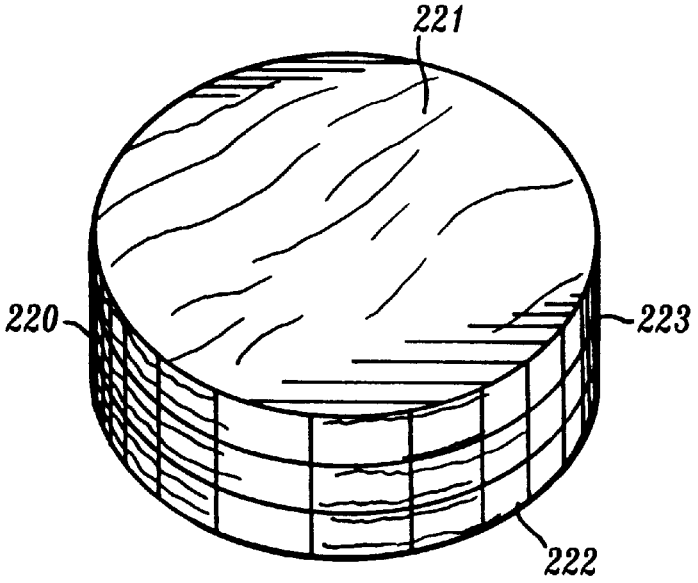
FIG. 15 is an isometric representational view of one embodiment of a boiler wick of the invention.
Figure 16:
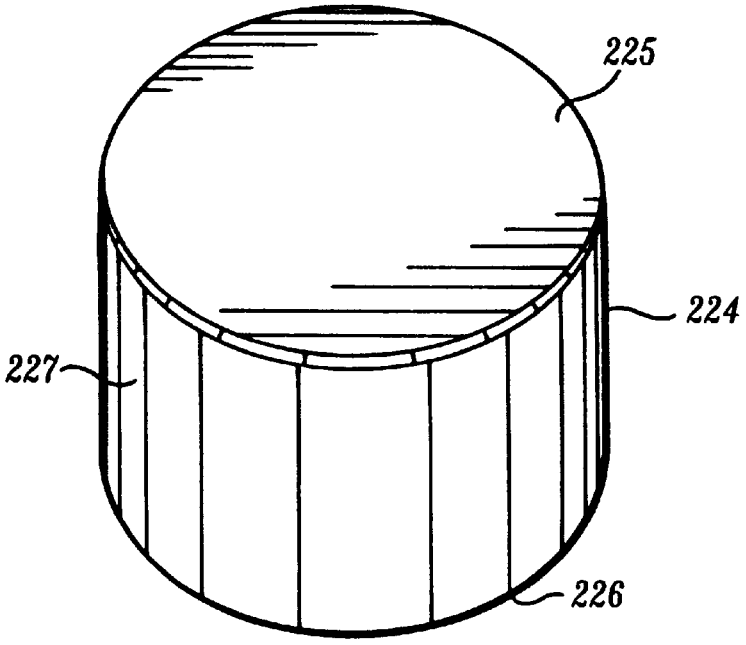
FIG. 16 is an isometric representational view of one embodiment of a transfer wick portion of the liquid feed supply of the invention.
Figure 17:
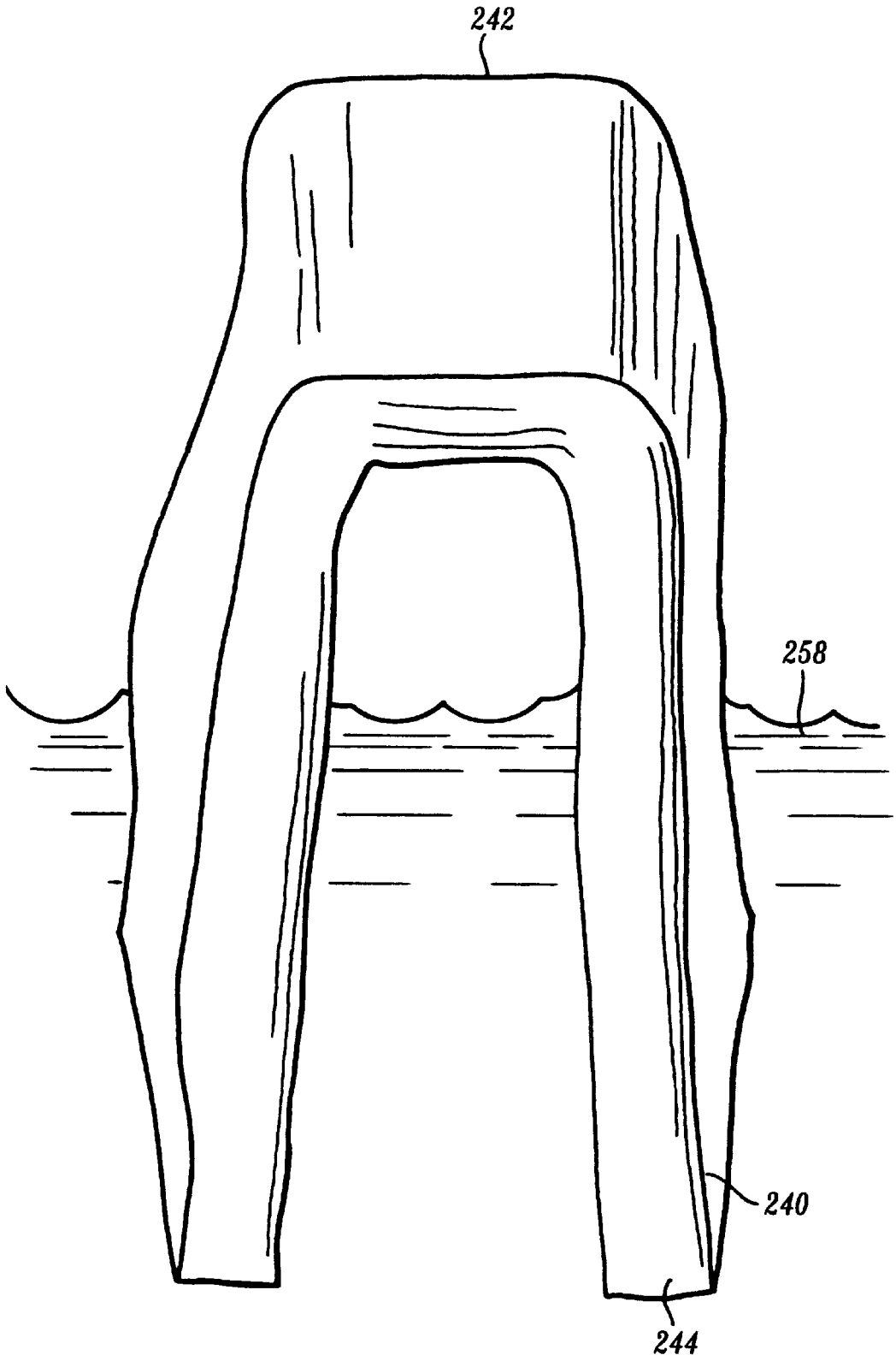
FIG. 17 is a perspective representational view of one embodiment of a supply wick portion of the liquid feed supply of the invention.

Referring now specifically to FIG. 14, in the preferred embodiment the lower surface 234 of hot seat 230 is provided with a series of narrow slots or grooves cut into the lower surface and extending approximately half of the vertical, or axial, length of hot seat 230. The material between the notches 236 form a series of parallel vanes 237 which contact the upper surface 221 of boiler wick 220. The vanes 237 provide a means of conducting heat from the hot seat to the boiler wick, while the notches 236 between the vanes provide flow passages for the vapor boiling out of boiler wick 220. The upper surface 232 of hot seat 230 is provided with a channel 238 extending sufficiently deep into the vertical length of the hot seat, so that fluid communication is provided from lower surface 234 through notches 236 and through channel 238 for boiling fuel vapors escaping from boiler wick 220 and on to aperture plate 250.

Referring again specifically to FIG. 13, aperture plate 250 is a generally cylindrical disk having upper and lower surfaces 252 and 254, respectively. Lower surface 254 mates with upper surface 232 of hot seat 230, and in the preferred embodiment is formed integrally therewith. Aperture plate 250 is provided with apertures 256 extending through the plate from upper surface 252 to lower surface 254 which provide fluid communication and flow passages for boiled fuel vapor from hot seat 230 to valve plate 260. Screw hole 258 in aperture plate 250 receives screw 288, as shown in FIG. 11, for holding valve plate 160 and additional portions of the apparatus in place.

Referring again to FIGS. 10 and 11, valve plate 260 is a generally cylindrical member having upper and lower surfaces 262 and 264, respectively, and generally circular edge 266. Valve plate 260 provides the dual functions of conducting heat from heat return tabs 290 to aperture plate 250 and thence to hot seat 230, and a means for throttling the flow of fuel vapor out of apertures 256 in aperture plate 250 and on to jet former 270. Heat return tabs 290 extend from edge 266 of valve plate 260, and may be formed integrally therewith. In the preferred embodiment, however, heat return tabs 290 are made of copper and attached to valve plate 260 by means of screws 291.

Starter guard 267, fixedly attached to valve plate 260, prevents operating starter assembly 380 unless valve plate 260 is rotated to align the boiler system for operation, as described below. Ports 268 extend generally vertically through valve plate 260 from lower surface 264 to upper surface 262, and when valve plate 260 is properly aligned, provide fluid communication for fuel vapor between apertures 256 in aperture plate 250 and jet former 270.

Upper surface 262 of valve plate 260 fixedly mates with lower surface 274 of jet former 270. Lower surface 264 of valve plate 260 closely and rotatably contacts upper surface 252 of aperture plate 250. By rotating valve plate 260 about screw 288 through action of control shaft 310, ports 268 in valve plate 260 can be made to come into varying alignment with apertures 256 in aperture plate 250, and thereby adjustably throttling the flow of fuel vapor exiting aperture plate 250 and escaping into jet former 270. In this way, the flame strength, and consequently the heat output, of the stove, may be regulated. In the preferred embodiment, valve plate 260 is made of aluminum, though in other embodiments it may be made of any heat conducting material.

Figure 19:
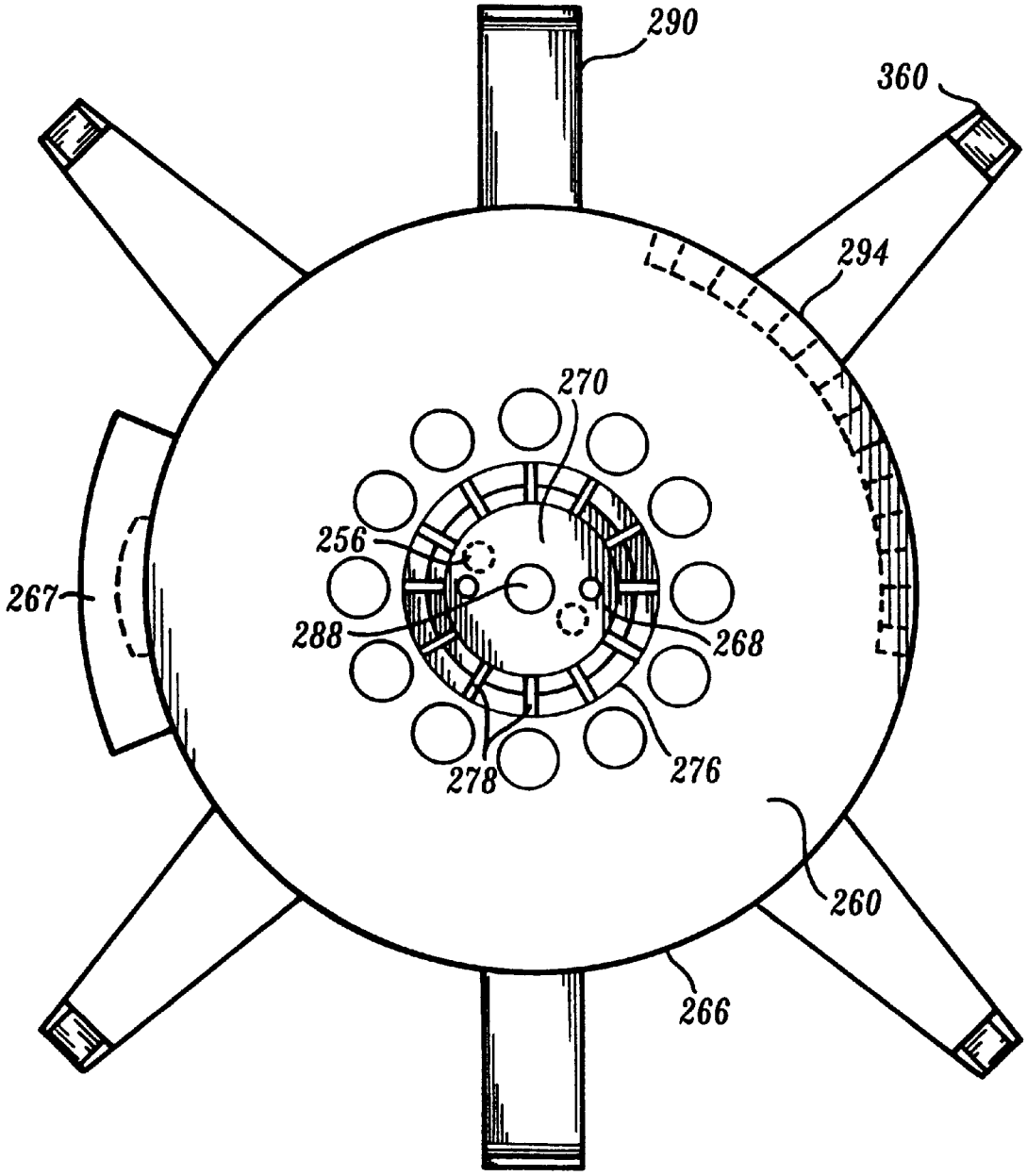
FIG. 19 is a top plan view of one embodiment of a flame plate and aperture and valve plates of the invention.

Referring now to FIGS. 11 and 19, jet former 270 is a generally cylindrical member forming a generally cylindrical hollow chamber, and having upper and lower surfaces 272 and 274, respectively, and an outer edge 276. A series of jet orifices 278 cut through outer edge 276 provide fluid paths for fuel vapor escaping from the central chamber of jet former 270. Jet orifices 278 are sized to form jets of escaping fuel vapor which mix with ambient air, the mixture being then burned to form flames 284. In the preferred embodiment, jet orifices 278 are narrow elemental slots. In the preferred embodiment, jet former 270 is integral with the upper surface 262 of valve plate 260. Jet former 270 rotates about screw 288 along with valve plate 260.

Flame plate 280 is a generally circular disk which sits atop, and is in fixed contact with upper surface 272 of jet former 270. Flame plate 280 rotates about screw 288, along with jet former 270 and valve plate 260. Flame plate 280 is sized in diameter to divert flames 284 horizontally outward from jet orifices 278 and form an essentially circular flame ring, suitable for cooking and heating purposes. In the preferred embodiment, flame plate 280 is made of ceramic, but in other embodiments it could be made of any suitable flame and heat proof material.

Referring specifically to FIG. 19, heat return tabs 290 are fixedly attached to, and extend horizontally outward from, edge 266 of valve plate 260 at equal intervals. The purpose of heat return tabs 290 is to transfer a portion of heat from flames 284 back to hot seat 230. Heat return tabs 290 are empirically sized and shaped to transfer the appropriate amount of heat through valve plate 260 and aperture plate 250 on to hot seat 230. At high vapor flow, a high heat flow is required to vaporize fuel in the boiler, while at low vapor flow, only a little heat is required to vaporize fuel in the boiler. Heat return tabs 290 are shaped and arranged to intercept a portion of flames 284. The size and location of flames 284 depends upon the setting of valve plate 260 relative to aperture plate 250. Therefore, the portion of flames 284 intercepted by heat return tabs 290 varies with the amount of the vapor throttling. This action provides a heat flow into heat return tabs 290 which is appropriate to any setting of the stove. As can be seen in the figures, heat return tabs 290 are angled upward from the horizontal at their ends, such that the larger flames 284 at higher burner settings will impinge upon the upturned ends of the heat return bars. In this way, more of the flames' heat is transferred to heat return tabs 290 and on to hot seat 230 for increased boiling rate. In the preferred embodiment, heat return tabs 290 are made integral with the valve plate 260.

Figure 20:
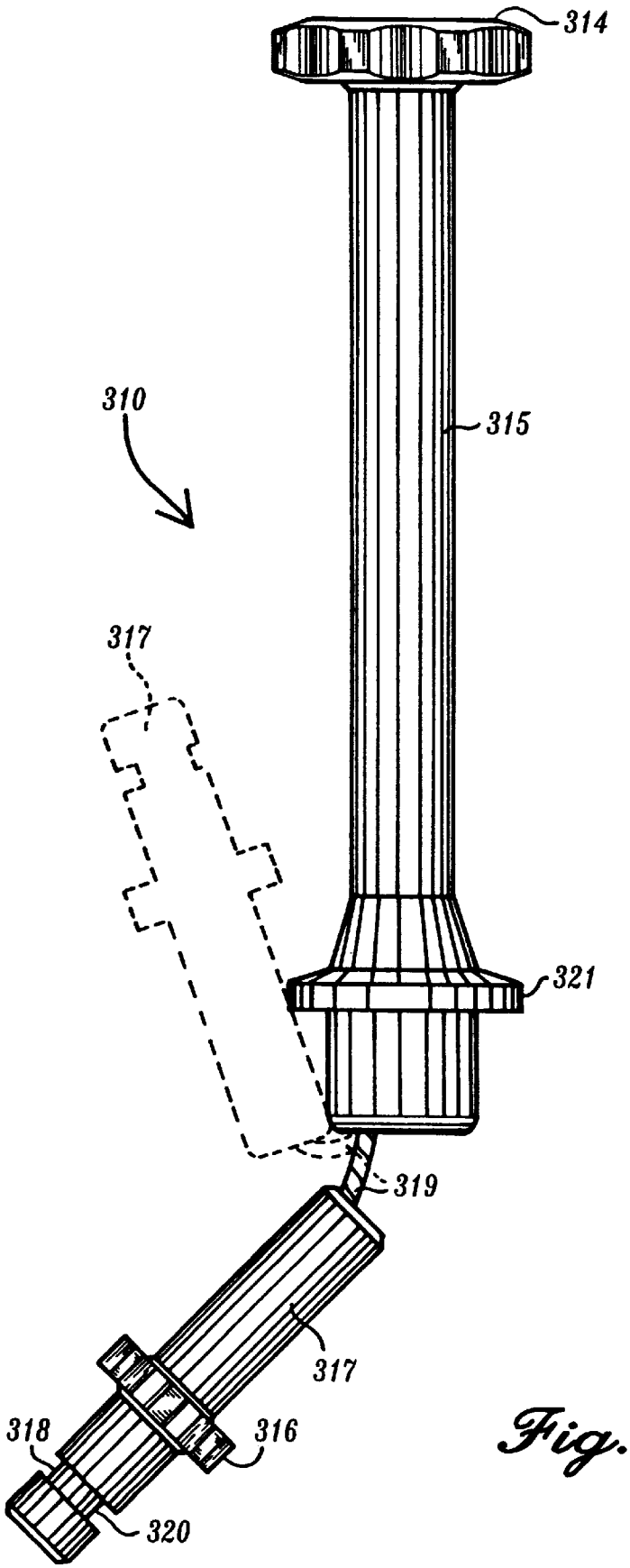
FIG. 20 is a top plan view of knob and pinion shafts showing a collapsibility feature of one embodiment of the invention.

Referring now to FIGS. 11 and 20, control shaft 310 interfits within, and extends from, shaft housing 312, which itself sits atop boiler frame 214. Control shaft 310 is comprised of two portions, knob shaft 315 and pinion shaft 317, one end of pinion shaft 317 being received within one end of knob shaft 315. Knob shaft 315 and pinion shaft 317 are generally cylindrical, hollow members tied together by internal resilient shock cord 319. This arrangement permits quick reassembly after collapsing the two shafts into a smaller length for ease of portability. Flange 321 of knob shaft 315 is specially shaped to prevent its sliding past fuel reservoir lid lip 353 and detaching from pinion shaft 315 unless control shaft 310 is in a position to shut all valves, thereby providing a stowage interlock.

Figure 18:
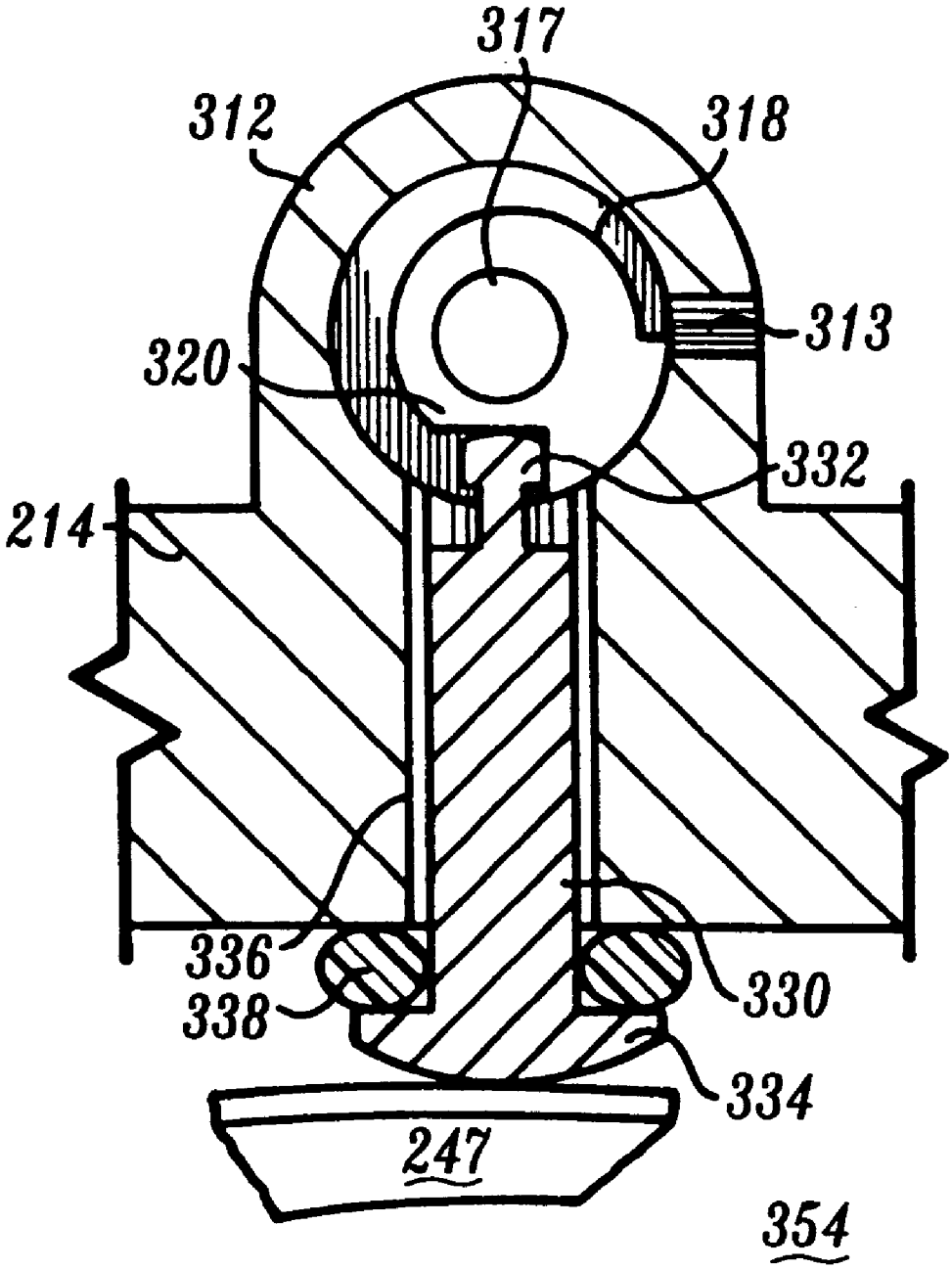
FIG. 18 is a cross-sectional view along line 18—18 of FIG. 11.

Control shaft 310 is used to manually control the heat output of the stove by varying the angular position of valve plate 260 relative to aperture plate 250. This is achieved by means of pinion 316 on pinion shaft 317. Pinion 316 interfits with face gear 294, which extends down from valve plate 260. When knob 314 is rotated by hand, causing pinion 316 to rotate and face gear 294 to translate relative to pinion 316, valve plate 260 is caused to rotate about screw 288, thus changing the throttling between aperture plate 250 and valve plate 260, and hence the vapor escaping to jet former 270 and the size of flames 284 exiting jet ports 278. Referring to FIG. 18, pinion shaft 317 is provided with slot 318 and detent 320 within slot 318. Slot 318 is an annular cut extending for 270° rotation of pinion shaft 317. Detent 320 is a flattened, slightly deeper section at one end of slot 318. Slot 318 and detent 320 control the position of vent piston 330 to provide an air path from vent hole 313 into gas space 354 within fuel reservoir 350, as described below.

Referring now to FIGS. 11 and 18, vent piston 330, having tip 332 at its upper end and head 334 at its lower end, is-slidably received into vent hole 336 in boiler frame 214. Spring 247 is a resilient, thin metallic semicircular member, the ends of which are fixed by nuts 249. Spring 247 acts on head 334 of vent piston 330, both to hold vent piston 330 in place, and to provide a positive, generally upward force on the piston to force tip 332 into positive engagement with slot 318 of control shaft 310. The diameter of the central portion of vent piston 330 is designed so that there is sufficient clearance between the piston and the inner walls of vent hole 336 to permit the passage of air. Tip 332 of vent piston 330 rides in slot 318 of control shaft 310 as control shaft 310 is rotated to control the heat output of the stove. Slot 318 is designed so that all angular positions of control shaft 310, except when tip 332 is seated in detent 320, vent piston 330 will be in a downward "open" position, permitting the passage of air from atmosphere through vent hole 313 into shaft housing 312, through vent hole 336 along the gap between vent piston 330 and the inner wall of vent hole 336 into gas space 354 of fuel reservoir 350. This air path prevents the drawing of a vacuum in gas space 354 as fuel is consumed and the level of liquid fuel 358 in fuel reservoir 350 decreases.

Slot 318 and detent 320 are placed so that when control shaft 310 has been rotated to close off the fuel vapor escape path through apertures 256 in aperture plate 250, and thus shut down the stove, tip 332 on vent piston 330 will be engaged in detent 320. Detent 320 is cut deeper into pinion shaft 317 than is slot 318, so that when detent 320 engages tip 332 of vent piston 330, vent piston 330 will slide higher into vent shaft 336, seating O-ring 338 at the lower end of vent shaft 336 to seal off the air flow path from atmosphere to gas space 354 and fuel reservoir 350. In this way, when the stove is shut down, fuel reservoir 350 is sealed closed to allow for the stove to be transported in any position relative to horizontal without the danger of leaking or spilling liquid fuel.

Figure 21:
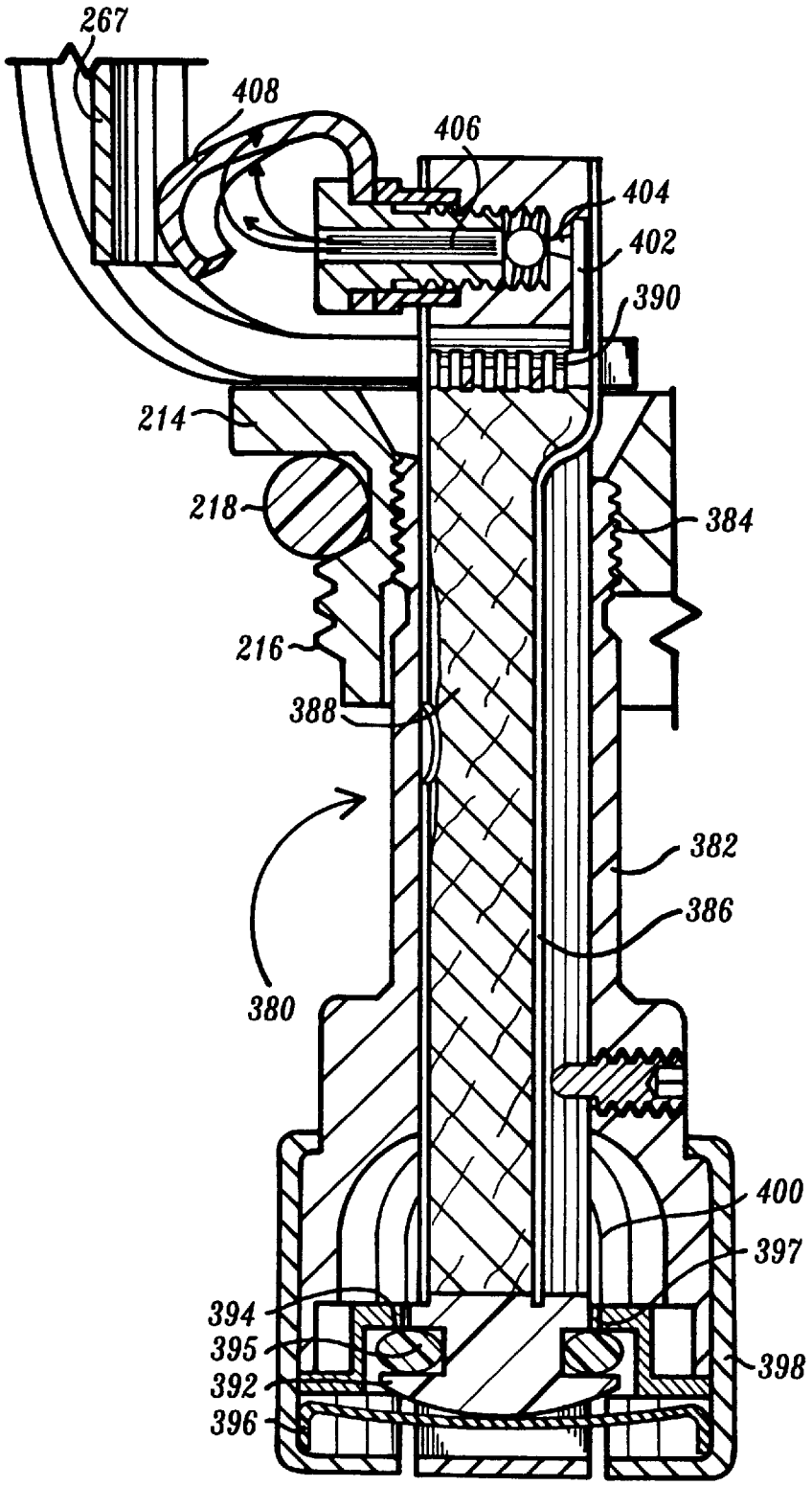
FIG. 21 is a detail view of a portion of FIG. 11 showing a starter assembly of the invention.

Referring now to FIGS. 11 and 21, starter assembly 380 is comprised of a generally cylindrical sheath 382 attached to boiler frame 214 by means of threads 384, and extending down into fuel reservoir 350. Generally cylindrical wick tube 386 is slidably disposed within, and extends a distance above sheath 382. Plunger 392, fixedly attached to the lower end of wick tube 386, moves vertically with wick tube 386. Spring bar 396 applies a generally upward force on plunger 392 and wick tube 386. O-ring 394, disposed within groove 395 in plunger 392, seals shut fuel inlet 397 when plunger 392 is in its uppermost position. Fuel chamber 400 communicates with fuel reservoir 350 when fuel inlet 397 is not blocked by O-ring 394. Starter hot seat 390 is fixedly disposed within wick tube 386 near its upper end. Starter hot seat 390 is a vane, channeled disc similar to hot seat 230 described above. Starter wick 388 is disposed within sheath 382 and extends from fuel chamber 400 up to the lower surface of starter hot seat 390. Starter wick 388 is made of Kevlar felt in a preferred embodiment, though other porous, flexible materials, or rigid porous materials, such as glass frit or ceramic, may be utilized. Whatever material is used for starter wick 388, the pores should be of appropriate size to wick fuel 358 from fuel chamber 400 up to starter hot seat 390 through capillary action and provide liquid fuel 358 to its upper end at the appropriate boiling pressures. The upper end of starter wick 388 is designed to be at its upper end pressed firmly against the lower surface of starter hot seat 390 and the inner surface of wick tube 386. With wick tube 386 acting as a shroud, starter hot seat 390 and the adjacent portion of starter wick 388 are designed to function as a capillary feed boiler for boiling liquid fuel 358 transferred by the starter wick 388 from fuel chamber 400. Heat transferred from starter hot seat 390 to the upper portion of starter wick 388, provides for a boiling transition from liquid to fuel vapor over the appropriate range of temperatures and pressures.

Boiled fuel vapor from starter hot scat 390 flows upward through passageway 402, through orifice 404, and out through jet tube 406, where the fuel vapor is mixed with air. A combustible mixture of air and fuel vapor exits jet tube 406 while flowing toward the left as shown in FIG. 11 and impinges upon flame shaper 408. Flame shaper 408 divides this gas flow into two equal portions to either side, and generally reverses its direction so that the flow moves toward the right as shown in FIG. 11. After division and redirection, the flow of combustible mixture burns and makes flames which heat the lower surface 264 of valve plate 260. At the same time, flame shaper 408, fixedly connected to the upper end of wick tube 386, captures some of the heat from the combusted starter fuel vapor and returns it back to starter hot seat 390. Retaining clip 398 holds spring bar 396, plunger 392, and wick tube 386 in place relative to sheath 382.

Operation of starter assembly 380 is as follows: After rotating control shaft 310 to rotate valve plate 260, and with it starter guard 267 away from flame shaper 408, flame shaper 408 is depressed momentarily. Depressing flame shaper 408 will cause wick tube 386, and with it plunger 392, to move downward within sheath 382 against the resistance offered by spring bar 396. When plunger 392 is moved downward, O-ring 394 will no longer block fuel inlet 397, thus allowing fuel 358 from fuel reservoir 350 to flow upward into fuel chamber 400. Once flame shaper 408 is released, wick tube 386 and plunger 392 will return upward, sealing O-ring 394 against fuel inlet 397 and trapping a predetermined amount of fuel into fuel chamber 400. The fuel trapped in fuel chamber 400 will be transported upward under capillary action by starter wick 388, until the liquid fuel reaches the upper end of starter wick 388 in the vicinity of starter hot seat 390.

A flame source is then directly applied to flame shaper 408, which transfers the heat of the flame source to starter hot seat 390. Starter hot seat 390 will transfer the heat to the upper portions of starter wick 388, increasing the temperature of the transported liquid fuel contained within the upper portion of starter wick 388. When the temperature of this liquid fuel reaches the boiling point for the prevailing pressure, the liquid fuel begins to boil. The fuel vapor produced will travel upward through the slots and channel in starter hot seat 390, through passageway 402 and orifice 404, and out through jet tube 406, whereupon it will mix with air and be ignited by the external flame source being applied to flame shaper 408. Once this ignition occurs, the flame source being applied to flame shaper 408 can be removed, since a portion of the heat released by the ignited fuel vapor will be returned through the flame shaper 408 back to starter hot seat 390 to produce a self sustaining capillary feed boiling action.

Flame shaper 408 is designed to direct the flame produced by the combusted starter fuel vapor upward on to valve plate 260, which will transfer the heat through aperture plate 250 to hot seat 230 to begin the main capillary feed boiling action in boiler wick 220. Once the fuel vapor produced by boiler wick 220 exits jet orifices 278, that fuel vapor will mix with air and be ignited by the flame from starter assembly 380 being directed upward by flame shaper 408. Heat return tabs 290 will return sufficient heat from the flames produced at jet orifices 278 to sustain the capillary feed boiling action in boiler wick 220. Once the liquid fuel in fuel chamber 400 has been exhausted by the combustion in the starter assembly 380, starter assembly combustion will cease. Fuel chamber 400 is designed to provide sufficient fuel for commencing a self-sustaining capillary feed boiling action in boiler wick 220 before the combustion in starter assembly 380 ceases.

Referring again to FIG. 10, support prongs 360 provide a surface for setting the cooking pan or other item to be heated by the stove. Support prongs 360 are bent metal tabs fixedly attached to boiler frame 214. Top 370 is also provided and sized to accommodate the outer circumference of fuel reservoir 350 forming an enclosure for easy transportation of the stove. Handle 372 permits top 370 to function as a cooking pot when inverted. The operation of the stove is as follows: first, liquid fuel 258 is added to fuel reservoir 350 by unscrewing boiler frame 214 and associated apparatus from fuel reservoir lid 352 at threads 216 to expose the interior of fuel reservoir 350. Liquid fuel may be added through the void left in lid 352 by the removed boiler frame 214. A sufficient amount of liquid fuel 358 is added so that when boiler frame 214 is reinstalled, ends 244 of supply wick 240 and plunger 444 will be submerged in fuel. Boiler frame 214 is then screwed back into place in lid 352 of fuel reservoir 350 until O-ring 218 is firmly compressed between boiler frame 214 and fuel reservoir lid 352, providing a tight seal between the interior of the fuel reservoir and atmosphere.

Knob 314 is then turned counter clockwise to rotate control shaft 310, and with it pinion gear 316 so that face gear 294, and with it valve plate 260, rotate clockwise as seen from above about screw 288 to open a fluid communication path between boiler wick 220 and jet former 270. As valve plate 260 rotates, starter guard 267 will move with it to expose flame shaper 408 on starter assembly 380. As control shaft 310, and with it pinion shaft 317, rotate, tip 332 of vent piston 330 disengages from detent 320 and moves counter clockwise along concentric cam slot 318 in pinion shaft 317. This movement causes vent piston 330 to move downward against spring clip 247 and open an air path from atmosphere through vent shaft 336 and into gas space 354 of fuel reservoir 350. The fluid communication path thereby created provides a means for air from the atmosphere to move into gas space 354 to fill the void created by the liquid fuel, which is consumed as the boiler operates.

Next, flame shaper 408 of starter assembly 380 is depressed through wick tube 386, plunger 392 and associated components downward against the resistive force of spring bar 396. This action will open fuel inlet 397 and allow liquid fuel 358 in fuel reservoir 350 to flow upward into fuel chamber 400. Flame shaper 408 is held down momentarily to allow fuel chamber 400 to fill. When flame shaper 408 is released, it, along with wick tube 386, plunger 392, and associated apparatus will move upward, sealing off fuel inlet 397 with O-ring 394. A few seconds delay is here necessary to give time for the liquid fuel in fuel chamber 400 to be transported via capillary action by starter wick 388 upward into the vicinity of starter hot seat 390. Then, an external flame source is applied to flame shaper 408 to heat it and concomitantly starter hot seat 390 to begin the boiling of the liquid fuel in starter wick 388. When fuel vapor exits jet tube 406 and mixes with air, it will be ignited by the external flame source to begin self sustaining combustion and capillary feed boiling of the starter assembly 380.

The combustion-flame produced by starter assembly 380 is directed upward and inward by flame shaper 408 and impinges against the adjacent portions of valve plate 260, heating it. This heat is transferred through valve plate 260, aperture plate 250, and hot seat 230 into boiler wick 220.

When the liquid fuel within boiler wick 220 is heated to its vaporization temperature for the extant capillary pressure, the fuel boils and the released fuel vapor escapes upward through the remainder of boiler wick 220, through notches 236 and channel 238 in hot seat 230, through apertures 256 and aperture plate 250, through ports 268 and valve plate 260 and into jet former 270, where it finally escapes through jet port 278. Upon exiting jet port 278 and mixing with air, the released fuel vapor is ignited by the flame from starter wick 340, thus starting the stove. Once the stove has been started, some of the heat from flames 284 is transmitted via valve plate 260, aperture plate 250 and hot seat 230 to boiler wick 220 to sustain the boiling process.

At higher stove outputs, determined by the position of valve plate 260 relative to aperture plate 250, flames 284 will extend a sufficient horizontal distance from jet port 278 to impinge upon heat return tabs 290 and thus provide additional heat transfer back to boiler wick 220 to sustain higher boiling rates necessary for higher fuel vapor production rates. As noted above, heat return tabs 290, as well as the other transfer components of the device, are constructed so than an empirically correct amount of heat is transferred to boiler wick 220 to sustain the boiling.

Once the stove is operational, a cooking pan or other item to be heated may be placed atop spider 360. As the cooking or other heating progresses, knob 314 may be used to rotate control shaft 310 as appropriate to throttle the flow of fuel vapor through valve plate 260 and into jet former 270, thus regulating the output of the stove. As different amounts of fuel vapor flow are demanded from the boiler, the heat transfer through hot seat 230 and into boiler wick 220 will automatically adjust to sustain boiling.

Figure 22:
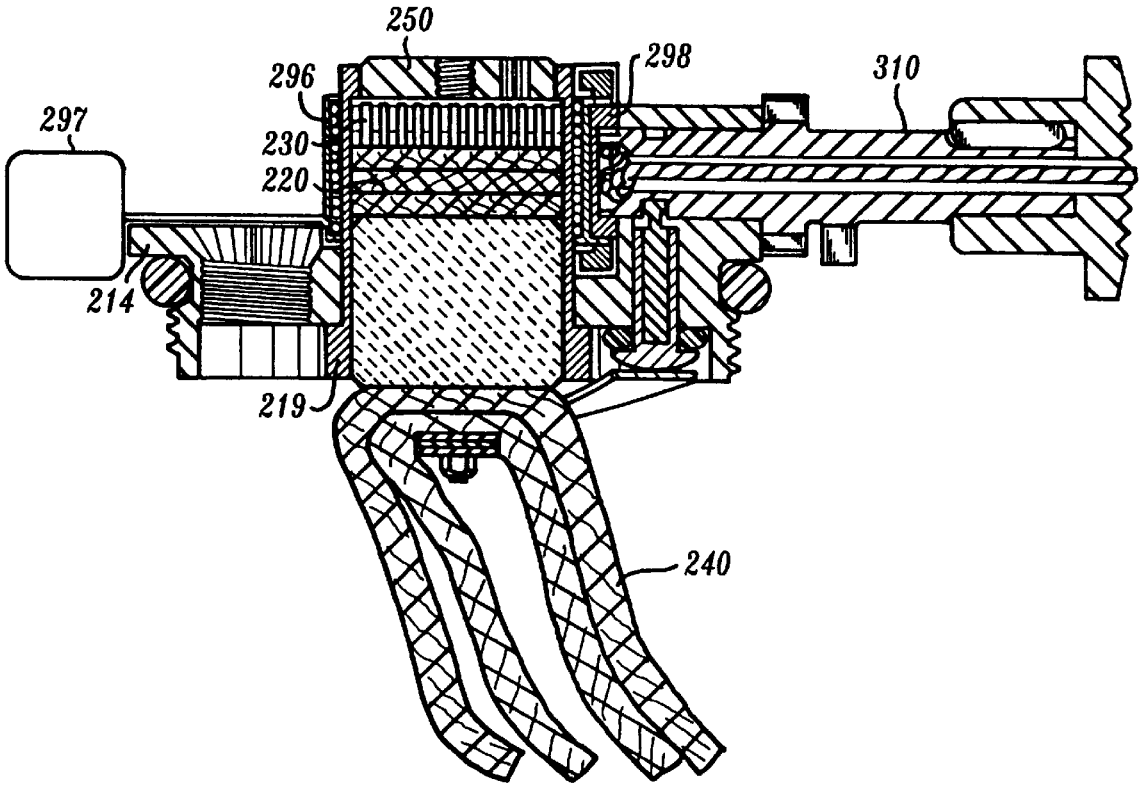
FIG. 22 is a side sectional elevational view of another embodiment of the invention.

Another embodiment of the liquid fuel stove employing a capillary feed boiler is depicted in FIG. 22. In this embodiment, heat return bars 290 are replaced by resistive heat elements 296 attached to shroud 219, and powered by battery 297. Other embodiments may employ a variety of other electrical power sources. In this embodiment, some heat from combustion inadvertently reaches the boiler by stray conductive, convective, and radiative heat paths. Resistive heat elements 296 add to this stray heat enough to maintain vapor flow. The electrical heat is controlled electronically to maintain the hot seat at a controllable temperature. The temperature of hot seat 230 is sensed by the resistance of the heat elements 296 using well-known electronic control techniques. With a knob, this temperature is controlled manually.

This embodiment of the invention does not require a vapor valve. Vapor flows unimpeded from the boiler to the jet forming orifices. The vapor flow depends upon the heat input to the boiler, which in turn depends upon the temperature of the hot seat. Therefore, the combustion output depends upon the controllable temperature of the hot seat.

In the embodiment described previously, control of the combustion output is achieved by throttling the fuel vapor flow by changing the relative positions of aperture plate 250 and valve plate 260. In this alternative embodiment, once valve plate 260 is rotated into an open position relative to aperture plate 250, valve plate 260 remains fixed, and stove output is controlled by controlling the heat output of resistive heat elements 296 and hence the boiling rate in boiler wick 220. Rheostat 298, attached to and manually controlled by the rotation of control shaft 310, varies the electrical supply to resistive heat elements 296, and hence the heat output of the heat elements. This arrangement provides an exacting method of controlling the output of the stove for applications in which accurate control is desired. Remaining portions of the camp stove of this alternative embodiment, such as jet former 270, vent piston 330 and starter wick 340, are similar to those of the previously described embodiment.

The following Example describes certain preferred embodiments of a combustion apparatus employing the vaporization/pressurization module of the present invention. While certain configurations, dimensions and materials are described, it will be understood that these are exemplary and the apparatus and methods of the present invention are not limited to these embodiments.

EXAMPLE

A combustion apparatus employing the vaporization/pressurization module of the present invention designed to burn white gas similar to that shown in FIGS. 2–4 was assembled. The liquid feed reservoir had the configuration illustrated in FIGS. 2–4 and was constructed from acrylic.

The feed wick shroud and porous member shroud comprised a unitary tubular member constructed from stainless steel. The overall length of the shroud was 2.0 inches; the outer diameter was 0.375 inch; the wall thickness was 0.010 inch; and the thin-walled portion of the shroud had a wall thickness of 0.004 inch. NOMEX was used as a feed wick and configured as shown in FIG. 3. Two vent apertures were provided as shown in FIG. 3.

A sintered bronze porous member retainer having a diameter of 0.357 inch and a thickness of 0.060 inch was baked to a golden brown color after machining, and then mounted in the shroud near the top of the feed wick. The porous member was composed of 15 discs of Millipore APFC 090 50 glass fiber filter material having a pore size of 1.2$\mu$, each disc having a diameter of 0.375 inch. The porous member was designed to fill the thin-walled shroud section having a length of 0.112 inch, and the discs were slightly compressed as they were positioned in contact with the porous member retainer. The discs were in contact with the inner shroud wall. A hot seat assembly having the configuration shown in FIGS. 5A, 5B and 5C was positioned in contact with the upper Millipore disc. The hot seat assembly was constructed from a tellurium-copper alloy and the grooves were chemically milled as described above.

The aperture plate was constructed as illustrated in FIGS. 6A and 6B from a tellurium copper alloy as a 0.375 inch diameter plate having a thickness of 0.020 inch. The diameter of the smaller diameter jet releasing aperture in the aperture plate was 0.009 inch. This aperture was the only vapor permeable aperture in the shroud/aperture plate combination forming the substantially vapor impermeable barrier.

The burner apparatus was similar to the burner illustrated in FIGS. 2–4 and was constructed from a tellurium-copper alloy. The burner had a central air passageway aligned with the central axis of the combustion apparatus and six air passageways having longitudinal axes parallel to the longitudinal axis of the central air passageway and provided in a radial arrangement with respect to the central air passageway. Three heat conductive posts were mounted in a radial arrangement near the outer rim of the burner apparatus as illustrated in FIGS. 2–4 and were also constructed from a tellurium-copper alloy. The burner cap was constructed from stainless steel, 300 series, and had an overall diameter of 0.500 inch. A flame spreader comprising stainless steel wire screen having an overall diameter of 0.750 inch; a wire diameter of 0.009 inch, and a pitch of 0.024 inch was used, as illustrated in FIGS. 2–4.

White gas was introduced into the fuel reservoir. A flame from a lighter was held near the burner cap for two to three seconds to initiate combustion. Following ignition, the combustion apparatus produced a very hot flame that burned steadily for minutes to hours, depending on the level of fuel provided in the fuel reservoir. The flame could be extinguished by inhibiting air flow to the burner apparatus or removing the feed wick from the fuel.

We claim:

1. A vaporization/pressurization module comprising:

a porous member composed of a material having a low thermal conductivity and having a liquid feed surfaces, a liquid vaporization zone, a vapor release surface generally opposite the liquid feed surface, and sidewalls;

a heat source in thermal communication with the porous member; and a substantially vapor impermeable barrier contacting the porous member sidewalls and in proximity to the porous member vapor release surface, the substantially vapor impermeable barrier having one or more vapor permeable locations permitting egress of pressurized vapor.

2. A vaporization/pressurization module according to claim 1, wherein the one or more vapor permeable locations and the substantially vapor impermeable barrier cooperate to form an enclosed space in proximity to surfaces of the porous member other than the liquid feed surface and permit egress of vapor to a location remote from the porous member only through the one or more vapor permeable apertures in proximity to the porous member vapor release surface.

3. A vaporization/pressurization module according to claim 1, additionally comprising a liquid feed system, and wherein the liquid feed system comprises a porous capillary member.

4. A vaporization/pressurization module according to claim 1, wherein the substantially vapor impermeable barrier comprises a first member contacting the porous member sidewalls and having a low thermal conductivity and a second member in proximity to the porous member vapor release surface having a high thermal conductivity.

5. A vaporization/pressurization module according to claim 1, wherein the heat source is in communication with an external power source.

6. A vaporization/pressurization module according to claim 1, wherein the substantially vapor impermeable barrier comprises a vapor impermeable shroud contacting the porous member sidewalls and an aperture plate having one or more vapor permeable apertures in proximity to the porous member vapor release surface.

7. A vaporization/pressurization module according to claim 1, wherein the porous member is composed of a porous ceramic material.

8. A combustion apparatus incorporating a vaporization/pressurization module comprising: a porous member composed of a material having a low thermal conductivity and having a liquid feed surface, a liquid vaporization zone, a vapor release surface generally opposite the liquid feed surface, and sidewalls; a heat source in thermal communication with the porous member; a substantially vapor impermeable barrier contacting the porous member sidewalls and in proximity to the porous member vapor release surface, the substantially vapor impermeable barrier having one or more vapor permeable locations permitting egress of pressurized vapor; and additionally comprising a liquid feed system for introducing liquid to the liquid feed surface of the porous member; and a burner assembly for mixing vapor produced within and/or on a surface of the porous member with a combustible gas to produce a combustible mixture and for burning the combustible mixture.

9. A combustion apparatus according to claim 8, additionally comprising means for conveying a portion of the heat generated during combustion of the combustible mixture to the heat source provided in thermal communication with the porous member.

10. A combustion apparatus according to claim 9, additionally comprising means for modulating the heat conveyed to the heat source.

11. A stove having a vaporization/pressurization module comprising: a porous member composed of a material having a low thermal conductivity and having a liquid feed surface, a liquid vaporization zone, a vapor release surface generally opposite the liquid feed surface, and sidewalls; a heat source in thermal communication with the porous member; a substantially vapor impermeable barrier contacting the porous member sidewalls and in proximity to the porous member vapor release surface, the substantially vapor impermeable barrier having one or more vapor permeable locations permitting egress of pressurized vapor; and additionally comprising: a liquid feed system for introducing liquid to the liquid feed surface of the porous member; and a burner assembly for mixing vapor produced within and/or on a surface of the porous member with a combustible gas to produce a combustible mixture and for burning the combustible mixture.

12. A heater having a vaporization/pressurization module comprising: a porous member composed of a material having a low thermal conductivity and having a liquid feed surface, a liquid vaporization zone, a vapor release surface generally opposite the liquid feed surface, and sidewalls; a heat source in thermal communication with the porous member; a substantially vapor impermeable barrier contacting the porous member sidewalls and in proximity to the porous member vapor release surface, the substantially vapor impermeable barrier having one or more vapor permeable locations permitting egress of pressurized vapor; and additionally comprising a liquid feed system for introducing liquid to the liquid feed surface of the porous member and a burner assembly for mixing vapor produced within and/or on a surface of the porous member with a combustible gas to produce a combustible mixture and for burning the combustible mixture.

13. A lamp having a vaporization/pressurization module comprising: a porous member composed of a material having a low thermal conductivity and having a liquid feed surface, a liquid vaporization zone, a vapor release surface generally opposite the liquid feed surface, and sidewalls; a heat source in thermal communication with the porous member; and a substantially vapor impermeable barrier contacting the porous member sidewalls and in proximity to the porous member vapor release surface, the substantially vapor impermeable barrier having one or more vapor permeable locations permitting egress of pressurized vapor; and additionally comprising a liquid feed system for introducing liquid to the liquid feed surface of the porous member, a burner assembly for mixing vapor produced within and/or on a surface of the porous member with a combustible gas to produce a combustible mixture and for burning the combustible mixture, and a mantle providing illumination during combustion of the combustible mixture.

14. A thermal to electric conversion system incorporating a vaporization/pressurization module comprising: a porous member composed of a material having a low thermal conductivity and having a liquid feed surface, a liquid vaporization zone, a vapor release surface generally opposite the liquid feed surface, and sidewalls; a heat source in thermal communication with the porous member; and a substantially vapor impermeable barrier contacting the porous member sidewalls and in proximity to the porous member vapor release surface, the substantially vapor impermeable barrier having one or more vapor permeable locations permitting egress of pressurized vapor; and additionally comprising a liquid feed system for introducing liquid to the liquid feed surface of the porous member and a burner assembly for mixing vapor produced within and/or on a surface of the porous member with a combustible gas to produce a combustible mixture and for burning the combustible mixture.

15. A vaporization/pressurization module comprising:

a porous cylindrical member having a circular liquid feed surface at one end, a circular vapor release surface at an opposite end, a continuous, cylindrical sidewall, and a liquid vaporization zone intermediate the liquid feed surface and the vapor release surface;

a heat source in thermal communication with the porous member; and a liquid and vapor impermeable cylindrical shroud contacting the continuous, cylindrical sidewall, and an aperture plate sealed to an end surface of the cylindrical shroud in proximity to the vapor release surface of the porous member, the aperture plate comprising a liquid and vapor impermeable material and having one or more apertures for release of pressurized vapor.

16. A method for vaporizing a liquid comprising:

contacting an unpressurized liquid to a liquid feed surface of a porous member composed of a material having a low thermal conductivity and capable of transporting liquid by capillary forces;

establishing a thermal gradient within the porous member, wherein the temperature at the liquid feed surface is generally ambient and the temperature at a vapor release surface generally opposite the liquid feed surface is at a temperature corresponding to the vaporization temperature of the liquid;

vaporizing liquid in proximity to the vapor release surface to produce liquid vapor; and collecting pressurized liquid vapor in a collection space in proximity to the vapor release surface and releasing the pressurized liquid vapor through one or more vapor permeable apertures.

17. A method for vaporizing and combusting liquid fuels comprising:

introducing a liquid fuel at substantially atmospheric temperature and pressure to a liquid feed surface of a porous member composed of a material having a low thermal conductivity and capable of transporting the liquid fuel within the porous member by capillary forces;

applying heat to a portion of the porous member and vaporizing the liquid fuel within and/or at a vapor release surface of the porous member to produce fuel vapor;

collecting vaporized fuel in a collection space in proximity to the vapor release surface and releasing the vaporized fuel, under pressure, through one or more vapor release apertures;

mixing the vaporized fuel with a combustible gas to produce a combustible mixture; and igniting and burning the combustible mixture.

18. A method according to claim 17, additionally comprising returning a portion of the heat generated during burning of the combustible mixture to a portion of the porous member for vaporizing the liquid fuel within and/or at a surface of the porous member.

19. A method according to claim 18, additionally comprising modulating the portion of heat returned to the porous member.

20. An apparatus for generating fuel vapor from a liquid fuel comprising:

a cylindrical capillary member having a first end adapted for communication with a liquid fuel, a second vapor release end adapted for releasing fuel vapor, and a continuous, cylindrical sidewall;

a vapor impermeable barrier forming a vapor collection space with between the barrier and the vapor release end of the capillary member, and including a channel for releasing vapor from said collection space;

means for sealing the continuous, cylindrical sidewall of said capillary member so that substantially all of fuel vapor produced by said capillary member exits across the vapor release end and is released into said collection space; and means for supplying heat to said capillary member for vaporizing said liquid fuel from said capillary member to form a stream of vapor through said channel.

21. The apparatus according to claim 20 further comprising a burner assembly in communication with said channel to mix said vapor with oxygen to form a combustible mixture which burns when ignited by a flame.

22. The apparatus of claim 21 wherein said means for supplying heat includes heat transfer means for coupling heat from said combustible mixture ignited by a flame to said capillary member.

23. The apparatus of claim 20 further comprising a liquid fuel surface for introducing a liquid fuel to said capillary member first side.

* * * * *